US008299007B2

(12) United States Patent
Carey et al.

(10) Patent No.: US 8,299,007 B2
(45) **Date of Patent: *Oct. 30, 2012**

(54) BASE STOCK LUBRICANT BLENDS

(75) Inventors: James T. Carey, Medford, NJ (US); Angela S. Galiano-Roth, Mullica Hill, NJ (US); Thomas G. Dietz, Clifton, VA (US)

(73) Assignee: ExxonMobil Research and Engineering Company, Annandale, NJ (US)

( * ) Notice: Subject to any disclaimer, the term of this patent is extended or adjusted under 35 U.S.C. 154(b) by 55 days.

This patent is subject to a terminal disclaimer.

(21) Appl. No.: 12/914,612

(22) Filed: Oct. 28, 2010

(65) Prior Publication Data

US 2011/0082063 A1 Apr. 7, 2011

Related U.S. Application Data

(63) Continuation-in-part of application No. 11/810,021, filed on Jun. 4, 2007, now abandoned.

(60) Provisional application No. 60/811,273, filed on Jun. 6, 2006.

(51) Int. Cl.
*C10M 107/02* (2006.01)
*C10M 161/00* (2006.01)

(52) U.S. Cl. ..... 508/591; 508/465; 508/571; 585/12; 208/19

(58) Field of Classification Search ..... 508/591
See application file for complete search history.

(56) References Cited

U.S. PATENT DOCUMENTS

| | | | |
|---|---|---|---|
| 2,978,442 | A | 4/1961 | Brightbill et al. |
| 3,149,178 | A | 9/1964 | Hamilton et al. |
| 3,164,578 | A | 1/1965 | Baker et al. |
| 3,382,291 | A | 5/1968 | Brennan |
| 3,576,923 | A | 4/1971 | Randell et al. |
| 3,742,082 | A | 6/1973 | Brennan |
| 3,769,363 | A | 10/1973 | Brennan |
| 3,780,128 | A | 12/1973 | Shubkin |
| 3,876,720 | A | 4/1975 | Heilman et al. |
| 3,883,417 | A | 5/1975 | Woo et al. |
| 4,016,349 | A | 4/1977 | McKenna |
| 4,132,663 | A | 1/1979 | Heilman et al. |
| 4,172,855 | A | 10/1979 | Shubkin et al. |
| 4,234,435 | A | 11/1980 | Meinhardt et al. |
| 4,239,930 | A | 12/1980 | Allphin et al. |
| 4,263,150 | A | 4/1981 | Clason et al. |
| 4,263,465 | A | 4/1981 | Sheng et al. |
| 4,289,635 | A | 9/1981 | Schroeck |
| 4,308,154 | A | 12/1981 | Clason et al. |
| 4,367,352 | A | 1/1983 | Watts, Jr. et al. |
| 4,413,156 | A | 11/1983 | Watts, Jr. et al. |
| 4,417,990 | A | 11/1983 | Clason et al. |
| 4,434,308 | A | 2/1984 | Larkin et al. |
| 4,451,684 | A | 5/1984 | Pasky |
| 4,469,912 | A | 9/1984 | Blewett et al. |
| 4,587,368 | A | 5/1986 | Pratt |
| 4,652,416 | A | 3/1987 | Millot |
| 4,701,489 | A | 10/1987 | Hughes et al. |
| 4,704,491 | A | 11/1987 | Tsutsui et al. |
| 4,776,967 | A | 10/1988 | Ichihashi et al. |
| 4,892,851 | A | 1/1990 | Ewen et al. |
| 4,906,799 | A | 3/1990 | Forbus, Jr. et al. |
| 4,910,355 | A | 3/1990 | Shubkin et al. |
| 4,912,272 | A * | 3/1990 | Wu ..... 585/10 |
| 4,914,254 | A | 4/1990 | Pelrine |
| 4,922,046 | A | 5/1990 | Kinoshita et al. |
| 4,926,004 | A | 5/1990 | Pelrine et al. |
| 4,943,383 | A | 7/1990 | Avery et al. |
| 4,950,822 | A | 8/1990 | Dileo et al. |
| 4,962,249 | A | 10/1990 | Chen et al. |
| 4,962,262 | A | 10/1990 | Winter et al. |
| 4,967,032 | A | 10/1990 | Ho et al. |
| 4,990,709 | A | 2/1991 | Wu |
| 5,012,020 | A | 4/1991 | Jackson et al. |
| 5,017,299 | A | 5/1991 | Gutierrez et al. |
| 5,017,714 | A | 5/1991 | Welborn, Jr. |
| 5,057,235 | A | 10/1991 | Farng et al. |
| 5,068,487 | A | 11/1991 | Theriot |

(Continued)

FOREIGN PATENT DOCUMENTS

| | | |
|---|---|---|
| DE | 19827323 | 6/1998 |

(Continued)

OTHER PUBLICATIONS

J. Brennan, "Wide-Temperature Range Synthetic Hydrocarbon Fluids", Ind. Eng. Chem. Prod. Res. Dev., 1980, vol. 19, pp. 2-6.

(Continued)

*Primary Examiner* — Ellen McAvoy
(74) *Attorney, Agent, or Firm* — Robert A. Migliorini; Derek M. Kato

(57) ABSTRACT

A method of improving air release is disclosed. The method comprises obtaining a lubricant comprising two base stocks. The first base stock comprises a viscosity greater than 100 cSt, Kv100° C. The second base stock comprises a viscosity less than 10 cSt, Kv100° C. In addition, a lubricant formulation and method of blending a lubricant formulation is also disclosed. The lubricant formulation comprises at least two base stocks. At least 5 percent and no more than 90 percent of a first base stock comprising oil with a viscosity greater than 300 cSt, Kv100° C. At least 5 percent and no more than 90 percent of a second base stock comprising oil with a viscosity less than 10 cSt, Kv100° C.

16 Claims, No Drawings

U.S. PATENT DOCUMENTS

| | | | | |
|---|---|---|---|---|
| 5,087,788 | A | 2/1992 | Wu | |
| 5,104,579 | A | 4/1992 | Benjamin et al. | |
| 5,113,030 | A | 5/1992 | Chen et al. | |
| 5,132,478 | A | 7/1992 | Ho et al. | |
| 5,146,021 | A | 9/1992 | Jackson et al. | |
| 5,157,177 | A | 10/1992 | Pelrine et al. | |
| 5,177,276 | A | 1/1993 | Beach et al. | |
| 5,186,851 | A | 2/1993 | Gutierrez et al. | |
| 5,187,250 | A | 2/1993 | Asanuma et al. | |
| 5,188,724 | A | 2/1993 | Heilman et al. | |
| 5,208,403 | A | 5/1993 | Buchanan et al. | |
| 5,220,100 | A | 6/1993 | Massie et al. | |
| 5,243,114 | A | 9/1993 | Johnson et al. | |
| 5,254,274 | A | 10/1993 | Ho et al. | |
| 5,264,642 | A | 11/1993 | Wu | |
| 5,276,227 | A | 1/1994 | Wu et al. | |
| 5,276,277 | A | 1/1994 | Hightower et al. | |
| 5,369,196 | A | 11/1994 | Matsumoto et al. | |
| 5,382,739 | A | 1/1995 | Atkins et al. | |
| 5,462,995 | A | 10/1995 | Hosaka et al. | |
| 5,498,815 | A | 3/1996 | Schaerfl, Jr. et al. | |
| 5,602,086 | A | 2/1997 | Le et al. | |
| 5,679,812 | A | 10/1997 | Winter et al. | |
| 5,688,887 | A | 11/1997 | Bagheri et al. | |
| 5,705,577 | A | 1/1998 | Rossi et al. | |
| 5,731,254 | A | 3/1998 | Winter et al. | |
| 5,807,949 | A | 9/1998 | Rossi et al. | |
| 5,811,379 | A | 9/1998 | Rossi et al. | |
| 5,846,896 | A | 12/1998 | Ewen | |
| 5,852,143 | A | 12/1998 | Sishta et al. | |
| 5,859,159 | A | 1/1999 | Rossi et al. | |
| 6,043,401 | A | 3/2000 | Bagheri et al. | |
| 6,080,301 | A | 6/2000 | Berlowitz et al. | |
| 6,087,307 | A | 7/2000 | Kaminski et al. | |
| 6,090,989 | A | 7/2000 | Trewella et al. | |
| 6,133,209 | A | 10/2000 | Rath et al. | |
| 6,147,271 | A | 11/2000 | Strebel et al. | |
| 6,165,949 | A | 12/2000 | Berlowitz et al. | |
| 6,180,575 | B1 | 1/2001 | Nipe | |
| 6,388,032 | B1 | 5/2002 | Yamaura et al. | |
| 6,395,948 | B1 | 5/2002 | Hope et al. | |
| 6,414,090 | B2 | 7/2002 | Minami et al. | |
| 6,479,722 | B1 | 11/2002 | De Wet et al. | |
| 6,548,723 | B2 | 4/2003 | Bagheri et al. | |
| 6,548,724 | B2 | 4/2003 | Bagheri et al. | |
| 6,642,169 | B2 | 11/2003 | Weatherhead | |
| 6,646,174 | B2 | 11/2003 | Clarembeau | |
| 6,706,828 | B2 | 3/2004 | DiMaio | |
| 6,713,438 | B1 * | 3/2004 | Baillargeon et al. | 508/463 |
| 6,824,671 | B2 | 11/2004 | Goze et al. | |
| 6,858,767 | B1 | 2/2005 | DiMaio et al. | |
| 6,869,917 | B2 | 3/2005 | Deckman et al. | |
| 7,022,784 | B2 | 4/2006 | Wu et al. | |
| 7,060,768 | B2 | 6/2006 | Brookhart et al. | |
| 7,129,197 | B2 | 10/2006 | Song et al. | |
| 7,312,185 | B2 | 12/2007 | Willey et al. | |
| 7,544,850 | B2 | 6/2009 | Goze et al. | |
| 7,547,811 | B2 | 6/2009 | Kramer et al. | |
| 7,585,823 | B2 | 9/2009 | Sullivan et al. | |
| 7,592,411 | B2 | 9/2009 | Wu et al. | |
| 7,592,497 | B2 | 9/2009 | Yang et al. | |
| 7,683,013 | B2 * | 3/2010 | Carey et al. | 508/110 |
| 7,795,194 | B2 | 9/2010 | Iimura et al. | |
| 2001/0041817 | A1 | 11/2001 | Bagheri et al. | |
| 2001/0041818 | A1 | 11/2001 | Bagheri et al. | |
| 2003/0055184 | A1 | 3/2003 | Song et al. | |
| 2003/0236177 | A1 | 12/2003 | Wu et al. | |
| 2004/0033908 | A1 | 2/2004 | Deckman et al. | |
| 2004/0087746 | A1 | 5/2004 | Razavi | |
| 2004/0092408 | A1 | 5/2004 | Willey et al. | |
| 2004/0097772 | A1 | 5/2004 | Deckers et al. | |
| 2004/0147693 | A1 | 7/2004 | DiMaio | |
| 2004/0220359 | A1 | 11/2004 | Abhari et al. | |
| 2004/0225088 | A1 | 11/2004 | Vaughan et al. | |
| 2004/0230016 | A1 | 11/2004 | Blackborow et al. | |
| 2005/0059563 | A1 | 3/2005 | Sullivan et al. | |
| 2005/0101761 | A1 | 5/2005 | Lambert et al. | |
| 2005/0183988 | A1 | 8/2005 | Freerks et al. | |
| 2006/0157383 | A1 | 7/2006 | Wu et al. | |
| 2007/0000807 | A1 * | 1/2007 | Wu et al. | 208/18 |
| 2007/0043248 | A1 | 2/2007 | Wu et al. | |
| 2007/0208151 | A1 | 9/2007 | Okada et al. | |
| 2007/0289897 | A1 | 12/2007 | Carey et al. | |
| 2007/0298990 | A1 * | 12/2007 | Carey et al. | 508/591 |
| 2008/0020954 | A1 | 1/2008 | Haigh et al. | |
| 2008/0177121 | A1 | 7/2008 | Wu et al. | |
| 2008/0207475 | A1 * | 8/2008 | Haigh et al. | 508/463 |
| 2009/0005279 | A1 | 1/2009 | Wu et al. | |
| 2009/0036725 | A1 | 2/2009 | Wu et al. | |
| 2009/0093657 | A1 | 4/2009 | Buchanan et al. | |
| 2009/0156874 | A1 | 6/2009 | Patil et al. | |
| 2009/0240012 | A1 | 9/2009 | Patil et al. | |
| 2010/0006259 | A1 | 1/2010 | Mori et al. | |
| 2010/0087349 | A1 * | 4/2010 | Lee et al. | 508/499 |
| 2010/0105589 | A1 | 4/2010 | Lee et al. | |
| 2010/0256026 | A1 * | 10/2010 | Wu et al. | 508/110 |
| 2010/0292424 | A1 | 11/2010 | Wu et al. | |
| 2010/0323937 | A1 * | 12/2010 | Wu et al. | 508/591 |
| 2011/0082061 | A1 * | 4/2011 | Carey et al. | 508/207 |
| 2011/0082063 | A1 | 4/2011 | Carey et al. | |
| 2011/0136714 | A1 * | 6/2011 | Haigh et al. | 508/583 |

FOREIGN PATENT DOCUMENTS

| | | | |
|---|---|---|---|
| EP | 0088453 | B1 | 5/1987 |
| EP | 0276320 | B1 | 8/1988 |
| EP | 0277004 | A1 | 8/1988 |
| EP | 0277007 | B1 | 8/1988 |
| EP | 0284708 | B1 | 10/1988 |
| EP | 0291006 | B1 | 11/1988 |
| EP | 0321852 | B1 | 6/1989 |
| EP | 0349276 | B1 | 1/1990 |
| EP | 0377306 | B1 | 7/1990 |
| EP | 0403866 | A1 | 12/1990 |
| EP | 0513380 | B1 | 11/1992 |
| EP | 0680942 | A1 | 5/1994 |
| EP | 0613873 | A2 | 9/1994 |
| EP | 0930320 | A1 | 7/1997 |
| EP | 1028128 | A1 | 10/1997 |
| EP | 0992517 | A2 | 9/1998 |
| EP | 1309633 | B1 | 8/2000 |
| EP | 1342707 | A2 | 9/2003 |
| EP | 1607415 | A1 | 12/2005 |
| EP | 1661921 | | 5/2006 |
| GB | 938069 | | 9/1963 |
| IN | 191553 | | 12/2003 |
| JP | 6336590 | A | 12/1994 |
| JP | 200500446 | A | 7/2005 |
| WO | 9623751 | | 8/1996 |
| WO | 9967347 | | 6/1999 |
| WO | 0214384 | A2 | 2/2002 |
| WO | 03009136 | A1 | 1/2003 |
| WO | 03020856 | A1 | 3/2003 |
| WO | 03051943 | A1 | 6/2003 |
| WO | 03071369 | A1 | 8/2003 |
| WO | 03104292 | A1 | 12/2003 |
| WO | 2004046214 | A2 | 6/2004 |
| WO | 2004053030 | A2 | 6/2004 |
| WO | 2007005094 | A1 | 1/2007 |
| WO | 2007011462 | A1 | 1/2007 |
| WO | 2007011832 | A1 | 1/2007 |
| WO | 2007145924 | A1 | 12/2007 |
| WO | 2007146081 | A1 | 12/2007 |
| WO | 2008010865 | A2 | 1/2008 |
| WO | 2009017953 | A2 | 2/2009 |
| WO | 2009123800 | A1 | 10/2009 |
| WO | 2009137264 | A1 | 11/2009 |

OTHER PUBLICATIONS

K. Denbigh, "The Kinetics of Continuous Reaction Processes: Application to Polymerization", J. Applied Chem, 1951, vol. 1, pp. 227-236.

K. Denbigh, "Continuous Reactions: Part II. The Kinetics of Steady State Polymerisation", Trans Faraday Soc., 1947, vol. 43, pp. 648-660.

A. Munoz-Escalona, et al., "Single-Site Supported Catalysts for Ethylene Polymerization", Metallocene Tech., 1999, pp. 2242-2246.

Z. Fan, et al., "Effect of Ethoxy- and Methoxysilane Donors in Propene/1-Hexene Copolymerization with High-Yield Supported Ziegler-Natta Catalysts", Macromolecular Chemistry and Physics, 1994, vol. 195, pp. 3889-3899.
G. Gokel, ed., "Dean's Handbook of Organic Chemistry", 2nd Edition, McGraw-Hill, 2004, available on-line at hhtp://knovel.com.
M. LeVan, et al., "Adsorption and Ion Exchange", Perry's Chemical Engineer's Handbook, 7th ed., 1997, pp. 16-1-16-66.
O. Levenspiel, "Ch. 7: Design for Multiple Reactions", Chemical Reaction Engineering, 2nd ed., 1972, pp. 196-209.
N. Naga, et al., "Effect of Co-Catalyst System on a-Olefin Polymerization with Rac- and Meso-[Dimethylsilylenebis (2,3,5-Trimethyl-Cyclopentadieny1)] Zirconium Dichloride", Macromol. Rapid Commun., 1997, vol. 18, pp. 581-589.
N. Naga, et al., "Polymerization Behavior of a-Olefins with Rac- and Meso-Type Ansa-Metallocene Catalyst: Effects of Cocatalyst and Metallocene Ligand", Macromolecular Chemistry Physics, 1999, vol. 200, pp. 1587-1594.
F. Rodriguez, "The Molecular Weight of Polymers", Principles of Polymer Systems, 1970, Chapter 6, pp. 115-144.
M. Sacchi, et al., "Use of Different Alkoxysilanes as External Donors in MgCl2-Supported Ziegler-Natta Catalysts to Obtain Propene/1-Butene Copolymers with Different Microstructure", Macromolecular Chemistry and Physics, 1994, vol. 195, pp. 2805-2816.
T. Seraidaris, et al., "High-Molar-Mass Polypropene with Tunable Elastic Properties by Hafnocene/Borate Catalysts", Journal of Polymer Science: Part A: Polymer Chemistry, 2006, vol. 44, pp. 4743-4751.
J. Wills, "Synthetic Lubricants", Lubrication Fundamentals, Marcel Dekker Inc., New York, 1980, pp. 75-80.
"Mobil Releases SuperSyn PAO's", Lubrication Engineers, 1999, vol. 55, Part 8, pp. 45.
TIBA data, "TIBA datasheet" available on-line at www.albermarle.com on Aug. 26, 2010.
http://www.mobil.com/USA, Mobilgear®SHC XMP Series.

* cited by examiner

BASE STOCK LUBRICANT BLENDS

This application is a Continuation-in-Part of U.S. Ser. No. 11/810,021 filed Jun. 4, 2007, now Abandoned, which claims the benefit of U.S. Ser. No. 60/811,273 filed Jun. 6, 2006.

BACKGROUND

All lubricating oil systems contain some air. It can be found in four phases: free air, dissolved air, entrained air and foam. Free air is trapped in a system, such as an air pocket in a hydraulic line. Dissolved air is in solution with the oil and is not visible to the naked eye. Foam is a collection of closely packed bubbles surrounded by thin films of oil that collect on the surface of the oil.

Air entrainment is a small amount of air in the form of extremely small bubbles (generally less than 1 mm in diameter) dispersed throughout the bulk of the oil. Agitation of lubricating oil with air in equipment, such as bearings, couplings, gears, pumps, and oil return lines, may produce a dispersion of finely divided air bubbles in the oil. If the residence time in the reservoir is too short to allow the air bubbles to rise to the oil surface, a mixture of air and oil will circulate through the lubricating oil system. This may result in an inability to maintain oil pressure (particularly with centrifugal pumps), incomplete oil films in bearings and gears, and poor hydraulic system performance or failure. Air entrainment is treated differently than foam, and is most often a completely separate problem. A partial list of potential effects of air entrainment include: pump cavitation, spongy, erratic operation of hydraulics, loss of precision control; vibrations, oil oxidation, component wear due to reduced lubricant viscosity, equipment shut down when low oil pressure switches trip, "micro-dieseling" due to ignition of the bubble sheath at the high temperatures generated by compressed air bubbles, safety problems in turbines if overspeed devices do not react quickly enough, and loss of head in centrifugal pumps.

Antifoamants, including silicone additives help produce smaller bubbles in the bulk of the oil. In stagnant systems, the combination of smaller bubbles and greater sheath density can cause serious air entrainment problems. Turbine oil systems with quiescent reservoirs of several thousand gallons may have air entrainment problems with as little as a half a part per million silicone.

Casual exposure to silicone can have a significant effect on the lubricant. There are reports of air entrainment resulting from oil passing through hoses that had been formed on a silicone-coated mandrel. In one instance in a turbine application, all sources of air were removed, and the system was carefully evaluated, component by component, to check for sources of contamination. After an exhaustive search, the culprit was found to be a silicone coating on electrical cables that were immersed in oil. Other known causes of entrainment problems include contaminants, overadditizing and reservoir design.

One widely method to test air release properties of petroleum oils is ASTM D3427-03. This test method measures the time for the entrained air content to fall to the relatively low value of 0.2% under a standardized set of test conditions and hence permits the comparison of the ability of oils to separate entrained air under conditions where a separation time is available. The significance of this test method has not been fully established. However, entrained air can cause sponginess and lack of sensitivity of the control of turbine and hydraulic systems. This test may not be suitable for ranking oils in applications where residence times are short and gas contents are high.

In the ASTM D3427 method, compressed air is blown through the test oil, which has been heated to a temperature of 25, 50, or 75° C. After the air flow is stopped, the time required for the air entrained in the oil to reduce in volume to 0.2% is usually recorded as the air release time.

Most solutions to the air entrainment problem have been to redesign the reservoir or choose additives not likely to cause aeration issues. There is a need to create new base stocks, lubricant, additives and combinations thereof that have improved air release properties to reduce aeration issues. Accordingly, this invention satisfies that need.

SUMMARY

A method of achieving favorable air release properties is disclosed. The method comprises a lubricating oil comprising at least two base stocks with the viscosity difference between the first and second base stocks is greater than 96 cSt, Kv100° C. and the lubricating oil provides air release of less than 20 minutes time to 0.1% air in a ASTM D3427 test and lubricating with the lubricating oil.

In a second embodiment, a novel lubricant formulation is disclosed. In one embodiment the novel lubricant formulation comprises at least two base stocks. At least 5 percent and no more than 90 percent of a first base stock comprising a synthetic oil with a viscosity greater than 300 cSt, Kv100° C. At least 5 percent and no more than 90 percent of a second base stock comprising a oil with a viscosity less than 10 cSt, Kv100° C. with a viscosity difference of the first and second base stocks of at least 96 cSt, Kv100° C. The lubricant composition has a viscosity of greater than 4 cSt, Kv100° C. and a viscosity index of at least 130.

In a third embodiment a method for blending a novel formulation is also disclosed. The method comprises obtaining a first synthetic base stock lubricant, the first base stock having a viscosity greater than 100 cSt, Kv100° C., obtaining a second synthetic base stock lubricant, the second base stock lubricant has a viscosity less than 10 cSt, Kv100° C., and mixing the first and second base stock lubricant to produce the lubricating oil wherein the lubricating oil to provide a viscosity greater than 3.5 cSt Kv 100° C. and a viscosity index greater than 120.

In addition, methods are disclosed to improve both the scanning Brookfield Viscosities and lower the pour points. These methods comprise obtaining a lubricating oil comprising at least two base stocks, at least 10 percent and no more than 60 percent of a first base stock comprising a synthetic oil with a viscosity greater than 100 cSt, Kv100° C., at least 5 percent and no more than 30 percent of a second base stock comprising a oil with a viscosity less than 6 cSt, Kv100° C., wherein the lubrication oil provides a Scanning Brookfield Viscosities of less than 6000 cP at −5 degrees Celsius using a ASTM D5133 test and lubricating with the lubricating oil.

DETAILED DESCRIPTION

In U.S. Provisional Application No. 60/688,086, we have discovered a novel combination of base stocks that provides an unexpected increase in micropitting protection. We have also discovered that these base stocks provide improved aeration properties.

In one embodiment the lubricant formulation comprises at least two bases stocks with a viscosity difference between the first and the second bases stocks greater than 96 cSt, kv100°

C. and the lubricating oil provides an air release time to 0.2% air in the ASTM D3427 test to be 17 minutes or less. Also, a pour point reduction in the ASTM D97 test of 6° C. is observed. Kinematic Viscosity is determined by measuring the time for a volume of liquid to flow under gravity through a calibrated glass capillary viscometer. Viscosity is typically measured in centistokes (cSt, or $mm^2/s$) units. The ISO viscosity classification which is typically cited for industrial lubes of finished lubricants based on viscosities observed at 40° C. Base stock oils used to blend finished oils, are generally described using viscosities observed at 100° C.

In a second embodiment, the novel lubricant formulation comprises at least two base stocks. The first base stock comprising synthetic oil with a viscosity greater than 150 cST, KV100° C. The second base stock comprises oil with a viscosity less than 10 cST, KV100° C. In a preferred embodiment, the second base stock comprises lubricant oil with a viscosity of less than 6 cSt, Kv100° C. Preferably the viscosity of the second lubricant should be at least 2 cSt, Kv100° C. Even more preferable is a viscosity of between 3 and 5 cSt, Kv100° C.

A more specific example embodiment, is the combination of high viscosity index PAO 150 (150 cSt, Kv100° C.) and a low viscosity Poly Alpha Olefin ("PAO") including PAOs with a viscosity of less than 6 cSt, Kv100° C. and more preferably with a viscosity between 2 and 4 (2 cSt or 4 cSt, Kv100° C.) and even more preferably with a small amount of esters or alkylated aromatics. The esters including esters or alkylated aromatics can be used as an additional base stock or as a co-base stock with either the first or second base stocks for additive solubility. High viscosity index PAO 150 is a high viscosity synthetic lubricant oil and is a commercially available lubricant sold by ExxonMobil Corporation in Fairfax Va. while esters and PAOs are commercially available commodity lubricants. The preferred ester is an alkyl adipate.

Table 1 is a table showing the air release benefit based of the fully formulated subject oil using the extreme viscosities of the blended bases stocks and a typical ISO 320 fully formulated commercially available gear oil product. The current invention is a lubricating oil with a first base oil of at least 300 cSt, kv100° C. and a second base oil of less than 10 cSt, kv100° C. This invention was compared against a typical ISO 320 gear oil with a first base oil of 100 cSt, kv100° C. and a second base oil of less than 6 cSt, kv100° C.

TABLE 1

FIG. 1: ASTM D3427 (75C) Results

| Air Release in Minutes | Current Invention | Typical ISO 320 Gear Oil |
|---|---|---|
| Time to 0.1% air | 14 | 25 |
| Time to 0.2% air | 12 | 21 |

The air release performance enhancement of the current invention is an unexpected result since the typical performance of these very viscous oils (ISO 320) is typically an air release time to 0.2% air in the ASTM D3427 test to be 20 minutes or more. Also, the low temperature performance of these novel formulations shows significant improvement as demonstrated in the ASTM D97 and D5133 data shown in Table 2. The air release performance enhancement of the current invention is unexpected and novel since the typical performance of these very viscous oils (ISO 320) is typically an air release time to 0.2% air in the ASTM D3427 test to be 20 minutes or more.

Table 2 is a table showing the low temperature benefit for the fully formulated subject oil using the extreme viscosities of the blended base stocks Oil is an embodiment of recurrent invention whereas the others are typical fully formulated commercially available products. The commercial products are labeled Oil B, oil C, and Oil D.

TABLE 2

| Temp (° C.) | Viscosity (cP) Oil A | Oil B | Oil C | Oil D |
|---|---|---|---|---|
| Scanning Brookfield Viscosity ASTM D5138 | | | | |
| −5.0 | 4,500 | 6,100 | 6,280 | 7,454 |
| −10.0 | 7,600 | 10,000 | 10,300 | 12,900 |
| −20.0 | 21,000 | 29,500 | 30,500 | 41,600 |
| −30.0 | 78,000 | 105,000 | 110,000 | 220,000 |
| −40.0 | 170,000 | 210,000 | 220,000 | TVM |
| Pour Point ASTM D97 | | | | |
| | −45° C. | −39° C. | −39° C. | −29° C. |

As can been seen in the Table 2 data, not only is the Pour Point (ASTM D97) of the current invention reduced, but also the resistance to thickening at lower temperatures can be observed in the Brookfield Viscosity data (ASTM D5133).

In a preferred embodiment, the base stocks include at least one base stock of synthetic oils and most preferably include at least one base stock of API group IV Poly Alpha Olefins. Synthetic oil for purposes of this application shall include all oils that are not naturally occurring mineral oils. Naturally occurring mineral oils are often referred to as API Group I oils.

Groups I, II, III, IV and V are broad categories of base oil stocks developed and defined by the American Petroleum Institute (API Publication 1509; www.API.org) to create guidelines for lubricant base oils. Group I base stocks generally have a viscosity index of between about 80 to 120 and contain greater than about 0.03% sulfur and/or less than about 90% saturates. Group II base stocks generally have a viscosity index of between about 80 to 120, and contain less than or equal to about 0.03% sulfur and greater than or equal to about 90% saturates. Group III stock generally has a viscosity index greater than about 120 and contains less than or equal to about 0.03% sulfur and greater than about 90% saturates. Group IV includes polyalphaolefins (PAO). Group V base stocks include base stocks not included in Groups I-IV. Table 2 summarizes properties of each of these five groups.

TABLE 2

Base Stock Properties

| | Saturates | Sulfur | Viscosity Index |
|---|---|---|---|
| Group I | <90% and/or | >0.03% and | ≧80 and <120 |
| Group II | ≧90% and | ≦0.03% and | ≧80 and <120 |
| Group III | ≧90% and | ≦0.03% and | ≧120 |
| Group IV | Polyalphaolefins (PAO) | | |
| Group V | All other base oil stocks not included in Groups I, II, III, or IV | | |

Base stocks having a high paraffinic/naphthenic and saturation nature of greater than 90 weight percent can often be used advantageously in certain embodiments. Such base stocks include Group II and/or Group III hydroprocessed or hydrocracked base stocks, or their synthetic counterparts such as polyalphaolefin oils, GTL or similar base oils or mixtures of similar base oils. For purposes of this application synthetic bases stocks shall include Group II, Group III, Group IV and Group V base stocks.

In a third embodiment, the novel lubricant formulation comprises at least two bases stocks. The first base stock comprising synthetic oil with a viscosity greater than 300 cST, KV100° C. The second base stock comprises oil with a viscosity less than 6 cST, KV100° C. The lubricant composition has a viscosity of greater than 4 cSt, Kv100° C. and a viscosity index of at least 130.

In addition to the above examples, The following base stock combinations give improved air release properties: high viscosity index PAO 150 cSt and gas to liquid ("GTL") base stocks or wax derived lubricants, high viscosity index PAO 150 cSt+Group III base stocks, high viscosity index PAO 150 cSt+Group II base stocks, high viscosity index PAO 150 cSt+PAO 100 (with or without Poly Iso Buthylene ("PIB"))+GTL base stocks, high viscosity index PAO 150 cSt+PAO 100 (with or without PIB)+Group III base stocks, high viscosity index PAO 150 cSt+PAO 100 (with or without PIB)+Group II base stocks, high viscosity index PAO 150 cSt+Brightstock (with or without PIB)+GTL base stocks, high viscosity index PAO 150 cSt+Brightstock (with or without PIB)+Group III base stocks, high viscosity index PAO 150 cSt+Brightstock (with or without PIB)+Group II base stocks. In addition, based on the disclosure herein other base stocks of widely disparate viscosities that give a "bi-modal" blending result can also be envisioned with the benefit of the disclosure herein to deliver enhanced micropitting protection to operating gearboxes.

Gas to liquid base stocks can also be preferentially used with the components of this invention as a portion or all of the base stocks used to formulate the finished lubricant. We have discovered, favorable improvement when the components of this invention are added to lubricating systems comprising primarily Group II, Group III and/or GTL base stocks compared to lesser quantities of alternate fluids.

GTL materials are materials that are derived via one or more synthesis, combination, transformation, rearrangement, and/or degradation/deconstructive processes from gaseous carbon-containing compounds, hydrogen-containing compounds, and/or elements as feedstocks such as hydrogen, carbon dioxide, carbon monoxide, water, methane, ethane, ethylene, acetylene, propane, propylene, propyne, butane, butylenes, and butynes. GTL base stocks and base oils are GTL materials of lubricating viscosity that are generally derived from hydrocarbons, for example waxy synthesized hydrocarbons, that are themselves derived from simpler gaseous carbon-containing compounds, hydrogen-containing compounds and/or elements as feedstocks. GTL base stock(s) include oils boiling in the lube oil boiling range separated/fractionated from GTL materials such as by, for example, distillation or thermal diffusion, and subsequently subjected to well-known catalytic or solvent dewaxing processes to produce lube oils of reduced/low pour point; wax isomerates, comprising, for example, hydroisomerized or isodewaxed synthesized hydrocarbons; hydroisomerized or isodewaxed Fischer-Tropsch ("F-T") material (i.e., hydrocarbons, waxy hydrocarbons, waxes and possible analogous oxygenates); preferably hydroisomerized or isodewaxed F-T hydrocarbons or hydroisomerized or isodewaxed F-T waxes, hydroisomerized or isodewaxed synthesized waxes, or mixtures thereof.

GTL base stock(s) derived from GTL materials, especially, hydroisomerized/isodewaxed F-T material derived base stock(s), and other hydroisomerized/isodewaxed wax derived base stock(s) are characterized typically as having kinematic viscosities at 100° C. of from about 2 $mm^2/s$ to about 50 $mm^2/s$, preferably from about 3 $mm^2/s$ to about 50 $mm^2/s$, more preferably from about 3.5 $mm^2/s$ to about 30 $mm^2/s$, as exemplified by a GTL base stock derived by the isodewaxing of F-T wax, which has a kinematic viscosity of about 4 $mm^2/s$ at 100° C. and a viscosity index of about 130 or greater. The term GTL base oil/base stock and/or wax isomerate base oil/base stock as used herein and in the claims is to be understood as embracing individual fractions of GTL base stock/base oil or wax isomerate base stock/base oil as recovered in the production process, mixtures of two or more GTL base stocks/base oil fractions and/or wax isomerate base stocks/base oil fractions, as well as mixtures of one or two or more low viscosity GTL base stock(s)/base oil fraction(s) and/or wax isomerate base stock(s)/base oil fraction(s) with one, two or more high viscosity GTL base stock(s)/base oil fraction(s) and/or wax isomerate base stock(s)/base oil fraction(s) to produce a dumbbell blend wherein the blend exhibits a viscosity within the aforesaid recited range. Reference herein to Kinematic viscosity refers to a measurement made by ASTM method D445.

GTL base stocks and base oils derived from GTL materials, especially hydroisomerized/isodewaxed F-T material derived base stock(s), and other hydroisomerized/isodewaxed wax-derived base stock(s), such as wax hydroisomerates/isodewaxates, which can be used as base stock components of this invention are further characterized typically as having pour points of about −5° C. or lower, preferably about −10° C. or lower, more preferably about −15° C. or lower, still more preferably about −20° C. or lower, and under some conditions may have advantageous pour points of about −25° C. or lower, with useful pour points of about −30° C. to about −40° C. or lower. If necessary, a separate dewaxing step may be practiced to achieve the desired pour point. References herein to pour point refer to measurement made by ASTM D97 and similar automated versions.

The GTL base stock(s) derived from GTL materials, especially hydroisomerized/isodewaxed F-T material derived base stock(s), and other hydroisomerized/isodewaxed wax-derived base stock(s) which are base stock components which can be used in this invention are also characterized typically as having viscosity indices of 80 or greater, preferably 100 or greater, and more preferably 120 or greater. Additionally, in certain particular instances, viscosity index of these base stocks may be preferably 130 or greater, more preferably 135 or greater, and even more preferably 140 or greater. For example, GTL base stock(s) that derive from GTL materials preferably F-T materials especially F-T wax generally have a viscosity index of 130 or greater. References herein to viscosity index refer to ASTM method D2270.

In addition, the GTL base stock(s) are typically highly paraffinic of greater than 90 percent saturates), and may contain mixtures of monocycloparaffins and multicycloparaffins in combination with non-cyclic isoparaffins. The ratio of the naphthenic (i.e., cycloparaffin) content in such combinations varies with the catalyst and temperature used. Further, GTL base stocks and base oils typically have very low sulfur and nitrogen content, generally containing less than about 10 ppm, and more typically less than about 5 ppm of each of these elements. The sulfur and nitrogen content of GTL base stock and base oil obtained by the hydroisomerization/isodewaxing of F-T material, especially F-T wax is essentially nil.

In a preferred embodiment, the GTL base stock(s) comprises paraffinic materials that consist predominantly of non-cyclic isoparaffins and only minor amounts of cycloparaffins. These GTL base stock(s) typically comprise paraffinic materials that consist of greater than 60 wt % non-cyclic isoparaffins, preferably greater than 80 wt % non-cyclic isoparaffins, more preferably greater than 85 wt % non-cyclic isoparaffins, and most preferably greater than 90 wt % non-cyclic isoparaffins.

Useful compositions of GTL base stock(s), hydroisomerized or isodewaxed F-T material derived base stock(s), and wax-derived hydroisomerized/isodewaxed base stock(s), such as wax isomerates/isodewaxates, are recited in U.S. Pat. Nos. 6,080,301; 6,090,989, and 6,165,949 for example.

We have discovered that this unique base stock combination can impart even further enhanced air release properties when combined with specific additive systems. The additives include various commercially available oil packages. These additive packages include a high performance series of components that include antiwear, antioxidant, defoamant, demulsifier, detergent, dispersant, metal passivation, and rust inhibition additive chemistries to deliver desired performance.

The additives may be chosen to modify various properties of the lubricating oils. For wind turbines, the additives should provide the following properties, antiwear protection, rust protection, micropitting protection, friction reduction, and improved filterability. Persons skilled in the art will recognize various additives that can be chosen to achieve favorable properties. These favorable properties include air release, scanning Brookfield Viscosities, and pour points.

The final lubricant should comprise a first lubricant base stock having a viscosity of greater than 100 cSt, Kv100° C. The first lubricant base stock should comprise of at least 5 percent and no more than 90 percent of the final lubricant. The second base stock having a viscosity less than 10 cSt should comprise at least 5 percent and no more than 90 percent of the final base stock total. The amount of ester and/or additive can be up to 90 percent of the final lubricant total with a proportional decrease in the acceptable ranges of first and second base stocks. The preferred range of esters and additives is between 10 and 90 percent.

A more preferred lubricant should comprise a first base stock with a viscosity of greater than 150 cSt, Kv100° C., the first base stock representing at least 5 percent of the final product and no more than 90 percent of the final lubricant. The second base stock is a PAO with a viscosity of 6 cSt, Kv100° C. and representing at least five percent of the final product and no more than 90 percent of the final product. An optional additional base stock includes a base stock with a viscosity of at least 6 cSt but no more than 100 cSt, Kv100° C. representing a range of between 0 and less than 65 percent of the final lubricant product. An ester additive package may range from 5 percent up to 25 percent of the final lubricant product.

In various embodiments, it will be understood that additives well known as functional fluid additives in the art, can also be incorporated in the functional fluid composition of the invention, in relatively small amounts, if desired; frequently, less than about 0.001% up to about 10-20% or more. In one embodiment, at least one oil additive is added from the group consisting of antioxidants, stabilizers, antiwear additives, dispersants, detergents, antifoam additives, viscosity index improvers, copper passivators, metal deactivators, rust inhibitors, corrosion inhibitors, pour point depressants, demulsifiers, anti-wear agents, extreme pressure additives and friction modifiers. The additives listed below are non-limiting examples and are not intended to limit the claims.

Dispersants should contain the alkenyl or alkyl group R has an Mn value of about 500 to about 5000 and an Mw/Mn ratio of about 1 to about 5. The preferred Mn intervals depend on the chemical nature of the agent improving filterability. Polyolefinic polymers suitable for the reaction with maleic anhydride or other acid materials or acid forming materials, include polymers containing a predominant quantity of C.sub.2 to C.sub.5 monoolefins, for example, ethylene, propylene, butylene, isobutylene and pentene. A highly suitable polyolefinic polymer is polyisobutene. The succinic anhydride preferred as a reaction substance is PIBSA, that is, polyisobutenyl succinic anhydride.

If the dispersant contains a succinimide comprising the reaction product of a succinic anhydride with a polyamine, the alkenyl or alkyl substituent of the succinic anhydride serving as the reaction substance consists preferably of polymerised isobutene having an Mn value of about 1200 to about 2500. More advantageously, the alkenyl or alkyl substituent of the succinic anhydride serving as the reaction substance consists in a polymerised isobutene having an Mn value of about 2100 to about 2400. If the agent improving filterability contains an ester of succinic acid comprising the reaction product of a succinic anhydride and an aliphatic polyhydric alcohol, the alkenyl or alkyl substituent of the succinic anhydride serving as the reaction substance consists advantageously of a polymerised isobutene having an Mn value of 500 to 1500. In preference, a polymerised isobutene having an Mn value of 850 to 1200 is used.

Amides suitable uses of amines include antiwear agents, extreme pressure additives, friction modifiers or Dispersants. The amides which are utilized in the compositions of the present invention may be amides of mono- or polycarboxylic acids or reactive derivatives thereof. The amides may be characterized by a hydrocarbyl group containing from about 6 to about 90 carbon atoms; each is independently hydrogen or a hydrocarbyl, aminohydrocarbyl, hydroxyhydrocarbyl or a heterocyclic-substituted hydrocarbyl group, provided that both are not hydrogen; each is, independently, a hydrocarbylene group containing up to about 10 carbon atoms; Alk is an alkylene group containing up to about 10 carbon atoms.

The amide can be derived from a monocarboxylic acid, a hydrocarbyl group containing from 6 to about 30 or 38 carbon atoms and more often will be a hydrocarbyl group derived from a fatty acid containing from 12 to about 24 carbon atoms.

The amide is derived from a di- or tricarboxylic acid, will contain from 6 to about 90 or more carbon atoms depending on the type of polycarboxylic acid. For example, when the amide is derived from a dimer acid, will contain from about 18 to about 44 carbon atoms or more, and amides derived from trimer acids generally will contain an average of from about 44 to about 90 carbon atoms. Each is independently hydrogen or a hydrocarbyl, aminohydrocarbyl, hydroxyhydrocarbyl or a heterocyclic-substituted hydrocarbon group containing up to about 10 carbon atoms. It may be independently heterocyclic substituted hydrocarbyl groups wherein the heterocyclic substituent is derived from pyrrole, pyrroline, pyrrolidine, morpholine, piperazine, piperidine, pyridine, pipecoline, etc. Specific examples include methyl, ethyl, n-propyl, n-butyl, n-hexyl, hydroxymethyl, hydroxyethyl, hydroxypropyl, amino-methyl, aminoethyl, aminopropyl, 2-ethylpyridine, 1-ethylpyrrolidine, 1-ethylpiperidine, etc.

The alkyl group can be an alkylene group containing from 1 to about 10 carbon atoms. Examples of such alkylene groups include, methylene, ethylene, propylene, etc. Also are hydrocarbylene groups, and in particular, alkylene group containing up to about 10 carbon atoms. Examples of such hydrocarbylene groups include, methylene, ethylene, propylene, etc. The amide contains at least one morpholinyl group. In one embodiment, the morpholine structure is formed as a result of the condensation of two hydroxy groups which are attached to the hydrocarbylene groups. Typically, the amides are prepared by reacting a carboxylic acid or reactive derivative thereof with an amine which contains at least one >NH group.

Aliphatic monoamines include mono-aliphatic and di-aliphatic-substituted amines wherein the aliphatic groups may be saturated or unsaturated and straight chain or branched chain. Such amines include, for example, mono- and di-alkyl-substituted amines, mono- and dialkenyl-substituted amines, etc. Specific examples of such monoamines include ethyl amine, diethyl amine, n-butyl amine, di-n-butyl amine, isobutyl amine, coco amine, stearyl amine, oleyl amine, etc. An example of a cycloaliphatic-substituted aliphatic amine is 2-(cyclohexyl)-ethyl amine. Examples of heterocyclic-substituted aliphatic amines include 2-(2-aminoethyl)-pyrrole, 2-(2-aminoethyl)-1-methylpyrrole, 2-(2-aminoethyl)-1-methylpyrrolidine and 4-(2-aminoethyl)morpholine, 1-(2-aminoethyl)piperazine, 1-(2-aminoethyl)piperidine, 2-(2-aminoethyl)pyridine, 1-(2-aminoethyl)pyrrolidine, 1-(3-aminopropyl)imidazole, 3-(2-aminopropyl)indole, 4-(3-aminopropyl)morpholine, 1-(3-aminopropyl)-2-pipecoline, 1-(3-aminopropyl)-2-pyrrolidinone, etc.

Cycloaliphatic monoamines are those monoamines wherein there is one cycloaliphatic substituent attached directly to the amino nitrogen through a carbon atom in the cyclic ring structure. Examples of cycloaliphatic monoamines include cyclohexyl amines, cyclopentylamines, cyclohexenylamines, cyclopentenylamines, N-ethyl-cyclohexylamine, dicyclohexylamines, and the like. Examples of aliphatic-substituted, aromatic-substituted, and heterocyclic-substituted cycloaliphatic monoamines include propyl-substituted cyclohexyl-amines, phenyl-substituted cyclopentylamines, and pyranyl-substituted cyclohexylamine.

Aromatic amines include those monoamines wherein a carbon atom of the aromatic ring structure is attached directly to the amino nitrogen. The aromatic ring will usually be a mononuclear aromatic ring (i.e., one derived from benzene) but can include fused aromatic rings, especially those derived from naphthalene. Examples of aromatic monoamines include aniline, di-(para-methylphenyl)amine, naphthylamine, N-(n-butyl)-aniline, and the like. Examples of aliphatic-substituted, cycloaliphatic-substituted, and heterocyclic-substituted aromatic monoamines are para-ethoxyaniline, para-dodecylaniline, cyclohexyl-substituted naphthylamine, variously substituted phenathiazines, and thienyl-substituted aniline.

Polyamines are aliphatic, cycloaliphatic and aromatic polyamines analogous to the above-described monoamines except for the presence within their structure of additional amino nitrogens. The additional amino nitrogens can be primary, secondary or tertiary amino nitrogens. Examples of such polyamines include N-amino-propyl-cyclohexylamines, N,N'-di-n-butyl-paraphenylene diamine, bis-(para-aminophenyl)methane, 1,4-diaminocyclohexane, and the like.

The hydroxy-substituted amines contemplated are those having hydroxy substituents bonded directly to a carbon atom other than a carbonyl carbon atom; that is, they have hydroxy groups capable of functioning as alcohols. Examples of such hydroxy-substituted amines include ethanolamine, di-(3-hydroxypropyl)-amine, 3-hydroxybutyl-amine, 4-hydroxybutyl-amine, diethanolamine, di-(2-hydroxyamine, N-(hydroxypropyl)-propylamine, N-(2-methyl)-cyclohexylamine, 3-hydroxycyclopentyl parahydroxyaniline, N-hydroxyethal piperazine and the like.

In one embodiment, the amines useful in the present invention are alkylene polyamines including hydrogen, or a hydrocarbyl, amino hydrocarbyl, hydroxyhydrocarbyl or heterocyclic-substituted hydrocarbyl group containing up to about 10 carbon atoms, Alk is an alkylene group containing up to about 10 carbon atoms, and is 2 to about 10. Preferably, Alk is ethylene or propylene. Usually, a will have an average value of from 2 to about 7. Examples of such alkylene polyamines include methylene polyamines, ethylene polyamines, butylene polyamines, propylene polyamines, pentylene polyamines, hexylene polyamines, heptylene polyamines, etc.

Alkylene polyamines include ethylene diamine, triethylene tetramine, propylene diamine, trimethylene diamine, hexamethylene diamine, decamethylene diamine, hexamethylene diamine, decamethylene diamine, octamethylene diamine, di(heptamethylene) triamine, tripropylene tetramine, tetraethylene pentamine, trimethylene diamine, pentaethylene hexamine, di(trimethylene)triamine, and the like. Higher homologs as are obtained by condensing two or more of the above-illustrated alkylene amines are useful, as are mixtures of two or more of any of the afore-described polyamines.

Ethylene polyamines, such as those mentioned above, are especially useful for reasons of cost and effectiveness. Such polyamines are described in detail under the heading "Diamines and Higher Amines" in The Encyclopedia of Chemical Technology, Second Edition, Kirk and Othmer, Volume 7, pages 27-39, Interscience Publishers, Division of John Wiley and Sons, 1965, which is hereby incorporated by reference for the disclosure of useful polyamines. Such compounds are prepared most conveniently by the reaction of an alkylene chloride with ammonia or by reaction of an ethylene imine with a ring-opening reagent such as ammonia, etc. These reactions result in the production of the somewhat complex mixtures of alkylene polyamines, including cyclic condensation products such as piperazines.

Other useful types of polyamine mixtures are those resulting from stripping of the above-described polyamine mixtures. In this instance, lower molecular weight polyamines and volatile contaminants are removed from an alkylene polyamine mixture to leave as residue what is often termed "polyamine bottoms". In general, alkylene polyamine bottoms can be characterized as having less than 2, usually less than 1% (by weight) material boiling below about 200.degree. C. In the instance of ethylene polyamine bottoms, which are readily available and found to be quite useful, the bottoms contain less than about 2% (by weight) total diethylene triamine (DETA) or triethylene tetramine (TETA). A typical sample of such ethylene polyamine bottoms obtained from the Dow Chemical Company of Freeport, Tex. designated "E-100". Gas chromatography analysis of such a sample showed it to contain about 0.93% "Light Ends" (most probably DETA), 0.72% TETA, 21.74% tetraethylene pentamine and 76.61% pentaethylene hexamine and higher (by weight). These alkylene polyamine bottoms include cyclic condensation products such as piperazine and higher analogs of diethylene triamine, triethylene tetramine and the like.

The dispersants are selected from:

Mannich bases that are condensation reaction products of a high molecular weight phenol, an alkylene polyamine and an aldehyde such as formaldehyde, Succinic-based dispersants that are reaction products of a olefin polymer and succinic acylating agent (acid, anhydride, ester or halide) further reacted with an organic hydroxy compound and/or an amine, High molecular weight amides and esters such as reaction products of a hydrocarbyl acylating agent and a polyhydric aliphatic alcohol (such as glycerol, pentaerythritol or sorbitol). Ashless (metal-free) polymeric materials that usually contain an oil soluble high molecular weight backbone linked to a polar functional group that associates with particles to be dispersed are typically used as dispersants. Zinc acetate capped, also any treated dispersant, which include borated, cyclic carbonate, end-capped, polyalkylene maleic anhydride and the like; mixtures of some of the above, in treat rates that range from about 0.1% up to 10-20% or more. Commonly used hydrocarbon backbone materials are olefin polymers and copolymers, i.e.—ethylene, propylene, butylene, isobutylene, styrene; there may or may not be further functional groups incorporated into the backbone of the polymer, whose molecular weight ranges from 300 tp to 5000. Polar materials such as amines, alcohols, amides or esters are attached to the backbone via a bridge.

Antioxidants include sterically hindered alkyl phenols such as 2,6-di-tert-butylphenol, 2,6-di-tert-butyl-p-cresol and 2,6-di-tert-butyl-4-(2-octyl-3-propanoic) phenol; N,N-di (alkylphenyl) amines; and alkylated phenylene-diamines.

The antioxidant component may be a hindered phenolic antioxidant such as butylated hydroxytoluene, suitably present in an amount of 0.01 to 5%, preferably 0.4 to 0.8%, by weight of the lubricant composition. Alternatively, or in addition, component b) may comprise an aromatic amine antioxidant such as mono-octylphenylalphanapthylamine or p,p-dioctyldiphenylamine, used singly or in admixture. The amine anti-oxidant component is suitably present in a range of from 0.01 to 5% by weight of the lubricant composition, more preferably 0.5 to 1.5%.

A sulfur-containing antioxidant may be any and every antioxidant containing sulfur, for example, including dialkyl thiodipropionates such as dilauryl thiodipropionate and distearyl thiodipropionate, dialkyldithiocarbamic acid derivatives (excluding metal salts), bis(3,5-di-t-butyl-4-hydroxybenzyl)sulfide, mercaptobenzothiazole, reaction products of phosphorus pentoxide and olefins, and dicetyl sulfide. Of these, preferred are dialkyl thiodipropionates such as dilauryl thiodipropionate and distearyl thiodipropionate. The amine-type antioxidant includes, for example, monoalkyldiphenylamines such as monooctyldiphenylamine and monononyldiphenylamine; dialkyldiphenylamines such as 4,4'-dibutyldiphenylamine, 4,4'-dipentyldiphenylamine, 4,4'-dihexyldiphenylamine, 4,4'-diheptyldiphenylamine, 4,4'-dioctyldiphenylamine and 4,4'-dinonyldiphenylamine; polyalkyldiphenylamines such as tetrabutyldiphenylamine, tetrahexyldiphenylamine, tetraoctyldiphenylamine and tetranonyldiphenylamine; and naphthylamines such as .alpha.-naphthylamine, phenyl-.alpha.-naphthylamine, butylphenyl-.alpha.-naphthylamine, pentylphenyl-.alpha.-naphthylamine, hexylphenyl-.alpha.-naphthylamine, heptylphenyl-.alpha.-naphthylamine, octylphenyl-.alpha.-naphthylamine and nonylphenyl-.alpha.-naphthylamine. Of these, preferred are dialkyldiphenylamines. The sulfur-containing antioxidant and the amine-type antioxidant are added to the base oil in an amount of from 0.01 to 5% by weight, preferably from 0.03 to 3% by weight, relative to the total weight of the composition.

The oxidation inhibitors that are particularly useful in lube compositions of the invention are the hindered phenols (e.g., 2,6-di-(t-butyl)phenol); aromatic amines (e.g., alkylated diphenyl amines); alkyl polysulfides; selenides; borates (e.g., epoxide/boric acid reaction products); phosphorodithioic acids, esters and/or salts; and the dithiocarbamate (e.g., zinc dithiocarbamates). These oxidation inhibitors as well as the oxidation inhibitors discussed above the preferably of the invention at levels of about 0.05% to about 5%, more preferably about 0.25 to about 2% by weight based on the total weight of such compositions; with ratios of amine/phenolic to be from 1:10 to 10:1 of the mixtures preferred.

The oxidation inhibitors that are also useful in lube compositions of the invention are chlorinated aliphatic hydrocarbons such as chlorinated wax; organic sulfides and polysulfides such as benzyl disulfide, bis(chlorobenzyl)disulfide, dibutyl tetrasulfide, sulfurized methyl ester of oleic acid, sulfurized alkylphenol, sulfurized dipentene, and sulfurized terpene; phosphosulfurized hydrocarbons such as the reaction product of a phosphorus sulfide with turpentine or methyl oleate, phosphorus esters including principally dihydrocarbon and trihydrocarbon phosphites such as dibutyl phosphite, diheptyl phosphite, dicyclohexyl phosphite, pentylphenyl phosphite, dipentylphenyl phosphite, tridecyl phosphite, distearyl phosphite, dimethyl naphthyl phosphite, oleyl 4-pentylphenyl phosphite, polypropylene (molecular weight 500)-substituted phenyl phosphite, diisobutyl-substituted phenyl phosphite; metal thiocarbamates, such as zinc dioctyldithiocarbamate, and barium heptylphenyl dithiocarbamate; Group II metal phosphorodithioates such as zinc dicyclohexylphosphorodithioate, zinc dioctylphosphorodithioate, barium di(heptylphenyl) (phosphorodithioate, cadmium dinonylphosphorodithioate, and the reaction of phosphorus pentasulfide with an equimolar mixture of isopropyl alcohol, 4-methyl-2-pentanol, and n-hexyl alcohol.

Oxidation inhibitors, organic compounds containing sulfur, nitrogen, phosphorus and some alkylphenols are also employed. Two general types of oxidation inhibitors are those that react with the initiators, peroxy radicals, and hydroperoxides to form inactive compounds, and those that decompose these materials to form less active compounds. Examples are hindered (alkylated) phenols, e.g. 6-di(tert-butyl)-4-methylphenol [2,6-di(tert-butyl)-p-cresol, DBPC], and aromatic amines, e.g. N-phenyl-.alpha.-naphthalamine. These are used in turbine, circulation, and hydraulic oils that are intended for extended service.

Examples of amine-based antioxidants include dialkyldiphenylamines such as p,p'-dioctyldiphenylamine (manufactured by the Seiko Kagaku Co. under the trade designation "Nonflex OD-3"), p,p'-di-.alpha.-methylbenzyl-diphenylamine and N-p-butylphenyl-N-p'-octylphenylamine; monoalkyldiphenylamines such as mono-t-butyldiphenylamine, and monooctyldiphenylamine; bis(dialkylphenyl) amines such as di(2,4-diethylphenyl)amine and di(2-ethyl-4-nonyl-phenyl)amine; alkylphenyl-1-naphthylamines such as octylphenyl-1-naphthylamine and N-t-dodecylphenyl-1-naphthylamine; arylnaphthylamines such as 1-naphthylamine, phenyl-1-naphthylamine, phenyl-2-naphthylamine, N-hexylphenyl-2-naphthylamine and N-octylphenyl-2-naphthyl amine, phenylenediamines such as N,N-diisopropyl-p-phenylenediamine and N,N'-diphenyl-p-phenylenediamine, and phenothiazines such as phenothiazine (manufactured by the Hodogaya Kagaku Co.: Phenothiazine) and 3,7-dioctylphenothiazine.

Examples of sulphur-based antioxidants include dialkylsulphides such as didodecylsulphide and dioctadecylsulphide; thiodipropionic acid esters such as didodecyl thiodipropionate, dioctadecyl thiodipropionate, dimyristyl thiodipropionate and dodecyloctadecyl thiodipropionate, and 2-mercaptobenzimidazole.

Examples of phenol-based antioxidants include 2-t-butylphenol, 2-t-butyl-4-methylphenol, 2-t-butyl-5-methylphenol, 2,4-di-t-butylphenol, 2,4-dimethyl-6-t-butylphenol, 2-t-butyl-4-methoxyphenol, 3-t-butyl-4-methoxyphenol, 2,5-di-t-butylhydroquinone (manufactured by the Kawaguchi Kagaku Co. under trade designation "Antage DBH"), 2,6-di-t-butylphenol and 2,6-di-t-butyl-4-alkylphenols such as 2,6-di-t-butyl-4-methylphenol and 2,6-di-t-butyl-4-ethylphenol; 2,6-di-t-butyl-4-alkoxyphenols such as 2,6-di-t-butyl-4-methoxyphenol and 2,6-di-t-butyl-4-ethoxyphenol, 3,5-di-t-butyl-4-hydroxybenzylmercaptoocty-1 acetate, alkyl-3-(3,5-di-t-butyl-4-hydroxyphenyl)propionates such as n-octyl-3-(3,5-di-t-butyl-4-hydroxyphenyl)propionate (manufactured by the Yoshitomi Seiyaku Co. under the trade designation "Yonox SS"), n-dodecyl-3-(3,5-di-t-butyl-4-hydroxyphenyl) propionate and 2'-ethylhexyl-3-(3,5-di-t-butyl-4-hydroxyphenyl)propionate; 2,6-di-t-butyl-.alpha.-dimethylamino-p-cresol, 2,2'-methylenebis(4-alkyl-6-t-butylphenol) compounds such as 2,2'-methylenebis(4-methyl-6-t-butylphe-nol) (manufactured by the Kawaguchi Kagaku Co. under the trade designation "Antage W-400") and 2,2'-methylenebis(4-ethyl-6-t-butylphenol) (manufactured by the Kawaguchi Kagaku Co. under the trade designation "Antage W-500"), bisphenols such as 4,4'-butylidenebis(3-methyl-6-t-butyl-phenol) (manufactured by the Kawaguchi Kagaku Co. under the trade designation "Antage W-300"), 4,4'-methylenebis(2,6-di-t-butylphenol) (manufactured by Laporte Performance Chemicals under the trade designation "Ionox 220AH"), 4,4'-bis(2,6-di-t-butylphenol), 2,2-(di-p-hydroxyphenyl)propane (Bisphenol A), 2,2-bis(3,5-di-t-butyl-4-hydroxyphenyl)propane, 4,4'-cyclohexylidenebis(2,6-di-t-butylphenol), hexamethylene glycol bis[3, (3,5-di-t-butyl-4-hydroxyphenyl)propionate] (manufactured by the Ciba Specialty Chemicals Co. under the trade designation "Irganox L109"), triethylene glycol bis[3-(3-t-butyl-4-hydroxy-y-5-methylphenyl)propionate] (manufactured by the Yoshitomi Seiyaku Co. under the trade designation "Tominox 917"), 2,2'-thio[diethyl-3-(3,5-di-t-1-butyl-4-hydroxyphenyl)propionate] (manufactured by the Ciba Specialty Chemicals Co. under the trade designation "Irganox L115"), 3,9-bis{1,1-dimethyl-2-[3-(3-t-butyl-4-hydroxy-5-methylphenyl)-propionylo-xy]ethyl}2,4,8,10-tetraoxaspiro[5,5]undecane (manufactured by the Sumitomo Kagaku Co. under the trade designation "Sumilizer GA80") and 4,4'-thiobis(3-methyl-6-t-butylphenol) (manufactured by the Kawaguchi Kagaku Co. under the trade designation "Antage RC"), 2,2'-thiobis(4,6-di-t-butylresorcinol); polyphenols such as tetrakis[methylene-3-(3,5-di-t-butyl-4-hydroxyphenyl)propionato]methane (manufactured by the Ciba Specialty Chemicals Co. under the trade designation "Irganox L101"), 1,1,3-tris(2-methyl-4-hydroxy-5-t-butylpheny-1)butane (manufactured by the Yoshitomi Seiyaku Co. under the trade designation "Yoshinox 930"), 1,3,5-trimethyl-2,4,6-tris(3,5-di-t-butyl-4-hydroxybenzyl)benzene (manufactured by Ciba Specialty Chemicals under the trade designation "Irganox 330"), bis[3,3'-bis(4'-hydroxy-3'-t-butylpheny-1)butyric acid]glycol ester, 2-(3',5'-di-t-butyl-4-hydroxyphenyl)-methyl-4-(2",4"-di-t-butyl-3"-hydroxyphenyl)methyl-6-t-butylphenol and 2,6-bis(2'-hydroxy-3'-t-butyl-5'-methylbenzyl)-4-methylphenol; and phenol/aldehyde condensates such as the condensates of p-t-butylphenol and formaldehyde and the condensates of p-t-butylphenol and acetaldehyde.

Viscosity index improvers and/or the pour point depressant include polymeric alkylmethacrylates and olefinic copolymers such as an ethylene-propylene copolymer or a styrene-butadiene copolymer or polyalkene such as PIB. Viscosity index improvers (VI improvers), high molecular weight polymers that increase the relative viscosity of an oil at high temperatures more than they do at low temperatures. The most common VI improvers are methacrylate polymers and copolymers, acrylate polymers, olefin polymers and copolymers, and styrene-butadiene copolymers.

Other examples of the viscosity index improver include polymethacrylate, polyisobutylene, alpha-olefin polymers, alpha-olefin copolymers (e.g., an ethylene-propylene copolymer), polyalkylstyrene, phenol condensates, naphthalene condensates, a styrenebutadiene copolymer and the like. Of these, polymethacrylate having a number average molecular weight of 10,000 to 300,000, and alpha-olefin polymers or alpha-olefin copolymers having a number average molecular weight of 1,000 to 30,000, particularly ethylene-alpha-olefin copolymers having a number average molecular weight of 1,000 to 10,000 are preferred.

The viscosity index increasing agents which can be used include, for example, polymethacrylates and ethylene/propylene copolymers, other non-dispersion type viscosity index increasing agents such as olefin copolymers like styrene/diene copolymers, and dispersible type viscosity index increasing agents where a nitrogen containing monomer has been copolymerized in such materials. These materials can be added and used individually or in the form of mixtures, conveniently in an amount within the range of from 0.05 to 20 parts by weight per 100 parts by weight of base oil.

Pour point depressors (PPD) include polymethacrylates. Commonly used additives such as alkylaromatic polymers and polymethacrylates are useful for this purpose; typically the treat rates range from 0.001% to 1.0%.

Detergents include calcium alkylsalicylates, calcium alkylphenates and calcium alkarylsulfonates with alternate metal ions used such as magnesium, barium, or sodium. Examples of the cleaning and dispersing agents which can be used include metal-based detergents such as the neutral and basic alkaline earth metal sulphonates, alkaline earth metal phenates and alkaline earth metal salicylates alkenylsuccinimide and alkenylsuccinimide esters and their borohydrides, phenates, salienius complex detergents and ashless dispersing agents which have been modified with sulphur compounds. These agents can be added and used individually or in the form of mixtures, conveniently in an amount within the range of from 0.01 to 1 part by weight per 100 parts by weight of base oil; these can also be high TBN, low TBN, or mixtures of high/low TBN.

Anti-rust additives include (short-chain) alkenyl succinic acids, partial esters thereof and nitrogen-containing derivatives thereof; and synthetic alkarylsulfonates, such as metal dinonylnaphthalene sulfonates. Anti-rust agents include, for example, monocarboxylic acids which have from 8 to 30 carbon atoms, alkyl or alkenyl succinates or partial esters thereof, hydroxy-fatty acids which have from 12 to 30 carbon atoms and derivatives thereof; sarcosines which have from 8 to 24 carbon atoms and derivatives thereof, amino acids and derivatives thereof, naphthenic acid and derivatives thereof, lanolin fatty acid, mercapto-fatty acids and paraffin oxides.

Particularly preferred anti-rust agents are indicated below. Examples of Monocarboxylic Acids (C8-C30), Caprylic acid, pelargonic acid, decanoic acid, undecanoic acid, lauric acid, myristic acid, palmitic acid, stearic acid, arachic acid, behenic acid, cerotic acid, montanic acid, melissic acid, oleic acid, docosanic acid, erucic acid, eicosenic acid, beef tallow fatty acid, soy bean fatty acid, coconut oil fatty acid, linolic acid, linoleic acid, tall oil fatty acid, 12-hydroxystearic acid, laurylsarcosinic acid, myritsylsarcosinic acid, palmitylsarcosinic acid, stearylsarcosinic acid, oleylsarcosinic acid, alkylated (C8-C20) phenoxyacetic acids, lanolin fatty acid and C8-C24 mercapto-fatty acids.

Examples of Polybasic Carboxylic Acids: The alkenyl (C10-C100) succinic acids indicated in CAS No. 27859-58-1 and ester derivatives thereof, dimer acid, N-acyl-N-alkyloxyalkyl aspartic acid esters (U.S. Pat. No. 5,275,749). Examples of the alkylamines which function as antirust additives or as reaction products with the above carboxylates to give amides and the like are represented by primary amines such as laurylamine, coconut-amine, n-tridecylamine, myristylamine, n-pentadecylamine, palmitylamine, n-heptadecylamine, stearylamine, n-nonadecyl amine, n-eicosylamine, n-heneicosylamine, n-docosylamine, n-tricosylamine, n-pentacosylamine, oleylamine, beef tallow-amine, hydrogenated beef tallow-amine and soy bean-amine. Examples of the secondary amines include dilaurylamine, di-coconut-amine, di-n-tridecylamine, dimyristylamine, di-n-pentadecylamine, dipalmitylamine, di-n-pentadecylamine, distearylamine, di-n-nonadecylamine, di-n-eicosylamine, di-n-heneicosylamine, di-n-docosylamine, di-n-tricosylamine, di-n-pentacosyl-amine, dioleylamine, di-beef tallow-amine, di-hydrogenated beef tallow-amine and di-soy bean-amine. Examples of the aforementioned N-alkylpolyalkyenediamines include: ethylenediamines such as laurylethylenediamine, coconut ethylenediamine, n-tridecylethylenediamine-, myristylethylenediamine, n-pentadecylethylenediamine, palmitylethylenediamine, n-heptadecylethylenediamine, stearylethylenediamine, n-nonadecylethylenediamine, n-eicosylethylenediamine, n-heneicosylethylenediamine, n-docosylethylendiamine, n-tricosylethylenediamine, n-pentacosylethylenediamine, oleylethylenediamine, beef tallow-ethylenediamine, hydrogenated beef tallow-ethylenediamine and soy bean-ethylenediamine; propylenediamines such as laurylpropylenediamine, coconut propylenediamine, n-tridecylpropylenediamine, myristylpropylenediamine, n-pentadecylpropylenediamine, palmitylpropylenediamine, n-heptadecylpropylenediamine, stearylpropylenediamine, n-nonadecylpropylenediamine, n-eicosylpropylenediamine, n-heneicosylpropylenediamine, n-docosylpropylendiamine, n-tricosylpropylenediamine, n-pentacosylpropylenediamine, diethylene triamine (DETA) or triethylene tetramine (TETA), oleylpropylenediamine, beef tallow-propylenediamine, hydrogenated beef tallow-propylenediamine and soy bean-propylenediamine; butylenediamines such as laurylbutylenediamine, coconut butylenediamine, n-tridecylbutylenediamine-myristylbutylenediamine, n-pentadecylbutylenediamine, stearylbutylenediamine, n-eicosylbutylenediamine, n-heneicosylbutylenedia-mine, n-docosylbutylendiamine, n-tricosylbutylenediamine, n-pentacosylbutylenediamine, oleylbutylenediamine, beef tallow-butylenediamine, hydrogenated beef tallow-butylenediamine and soy bean butylenediamine; and pentylenediamines such as laurylpentylenediamine, coconut pentylenediamine, myristylpentylenediamin-e, palmitylpentylenediamine, stearylpentylenediamine, oleylpentylenediamine, beef tallow-pentylenediamine, hydrogenated beef tallow-pentylenediamine and soy bean pentylenediamine.

Demulsifying agents include alkoxylated phenols and phenol-formaldehyde resins and synthetic alkylaryl sulfonates such as metallic dinonylnaphthalene sulfonates. A demulsifing agent is a predominant amount of a water-soluble polyoxyalkylene glycol having a pre-selected molecular weight of any value in the range of between about 450 and 5000 or more. An especially preferred family of water soluble polyoxyalkylene glycol useful in the compositions of the present invention may also be one produced from alkoxylation of n-butanol with a mixture of alkylene oxides to form a random alkoxylated product.

Functional fluids according to the invention possess a pour point of less than about −20 degree C., and exhibit compatibility with a wide range of anti-wear additive and extreme pressure additives. The formulations according to the invention also are devoid of fatigue failure that is normally expected by those of ordinary skill in the art when dealing with polar lubricant base stocks.

Polyoxyalkylene glycols useful in the present invention may be produced by a well-known process for preparing polyalkylene oxide having hydroxyl end-groups by subjecting an alcohol or a glycol ether and one or more alkylene oxide monomers such as ethylene oxide, butylene oxide, or propylene oxide to form block copolymers in addition polymerization while employing a strong base such as potassium hydroxide as a catalyst. In such process, the polymerization is commonly carried out under a catalytic concentration of 0.3 to 1.0% by mole of potassium hydroxide to the monomer(s) and at high temperature, as 100 degrees C. to 160 degrees C. It is well known fact that the potassium hydroxide being a catalyst is for the most part bonded to the chain-end of the produced polyalkylene oxide in a form of alkoxide in the polymer solution so obtained.

An especially preferred family of soluble polyoxyalkylene glycol useful in the compositions of the present invention may also be one produced from alkoxylation of n-butanol with a mixture of alkylene oxides to form a random alkoxylated product.

Foam inhibitors include polymers of alkyl methacrylate especially useful poly alkyl acrylate polymers where alkyl is generally understood to be methyl, ethyl propyl, isopropyl, butyl, or iso butyl and polymers of dimethylsilicone which form materials called dimethylsiloxane polymers in the viscosity range of 100 cSt to 100,000 cSt. Other additives are defoamers, such as silicone polymers which have been post reacted with various carbon containing moieties, are the most widely used defoamers. Organic polymers are sometimes used as defoamers although much higher concentrations are required.

Metal deactivating compounds/Corrosion inhibitors include 2,5-dimercapto-1,3,4-thiadiazoles and derivatives thereof, mercaptobenzothiazoles, alkyltriazoles and benzotriazoles. Examples of dibasic acids useful as anti-corrosion agents, other than sebacic acids, which may be used in the present invention, are adipic acid, azelaic acid, dodecanedioic acid, 3-methyladipic acid, 3-nitrophthalic acid, 1,10-decanedicarboxylic acid, and fumaric acid. The anti-corrosion combination is a straight or branch-chained, saturated or unsaturated monocarboxylic acid or ester thereof which may optionally be sulphurised in an amount up to 35% by weight. Preferably the acid is a C sub 4 to C sub 22 straight chain unsaturated monocarboxylic acid. The preferred concentration of this additive is from 0.001% to 0.35% by weight of the total lubricant composition. The preferred monocarboxylic acid is sulphurised oleic acid. However, other suitable materials are oleic acid itself; valeric acid and erucic acid. A component of the anti-corrosion combination is a triazole as previously defined. The triazole should be used at a concentration from 0.005% to 0.25% by weight of the total composition. The preferred triazole is tolylotriazole which may be included in the compositions of the invention include triazoles, thiazoles and certain diamine compounds which are useful as metal deactivators or metal passivators. Examples include triazole, benzotriazole and substituted benzotriazoles such as alkyl substituted derivatives. The alkyl substituent generally contains up to 1.5 carbon atoms, preferably up to 8 carbon atoms. The triazoles may contain other substituents on the aromatic ring such as halogens, nitro, amino, mercapto, etc. Examples of suitable compounds are benzotriazole and the tolyltriazoles, ethylbenzotriazoles, hexylbenzotriazoles, octylbenzotriazoles, chlorobenzotriazoles and nitrobenzotriazoles. Benzotriazole and tolyltriazole are particularly preferred. A straight or branched chain saturated or unsaturated monocarboxylic acid which is optionally sulphurised in an amount which may be up to 35% by weight; or an ester of such an acid; and a triazole or alkyl derivatives thereof, or short chain alkyl of up to 5 carbon atoms; n is zero or an integer between 1 and 3 inclusive; and is hydrogen, morpholino, alkyl, amido, amino, hydroxy or alkyl or aryl substituted derivatives thereof; or a triazole selected from 1,2,4 triazole, 1,2,3 triazole, 5-anilo-1,2,3,4-thiatriazole, 3-amino-1,2,4 triazole, 1-H-benzotriazole-1-yl-methylisocyanide, methylene-bis-benzotriazole and naphthotriazole.

Alkyl is straight or branched chain and is for example methyl, ethyl, n-propyl, iso-propyl, n-butyl, sec-butyl, n-pentyl, n-hexyl, n-heptyl, n-octyl, 2-ethylhexyl, n-nonyl, n-decyl, n-dodecyl, n-tetradecyl, n-hexadecyl, n-octadecyl or n-eicosyl.

Alkenyl is straight or branched chain and is for example prop-2-enyl, but-2-enyl, 2-methyl-prop-2-enyl, pent-2-enyl, hexa-2,4-dienyl, dec-10-enyl or eicos-2-enyl.

Cylcoalkyl is for example cyclopentyl, cyclohexyl, cyclooctyl, cyclodecyl, adamantyl or cyclododecyl.

Aralkyl is for example benzyl, 2-phenylethyl, benzhydryl or naphthylmethyl. Aryl is for example phenyl or naphthyl.

The heterocyclic group is for example a morpholine, pyrrolidine, piperidine or a perhydroazepine ring.

Alkylene moieties include for example methylene, ethylene, 1:2- or 1:3-propylene, 1:4-butylene, 1:6-hexylene, 1:8-octylene, 1:10-decylene and 1:12-dodecylene.

Arylene moieties include for example phenylene and naphthylene. 1-(or 4)-(dimethylaminomethyl)triazole, 1-(or 4)-(diethylaminomethyl)triazole, 1-(or 4)-(di-isopropylaminomethyl)triazole, 1-(or 4)-(di-n-butylaminomethyl)triazole, 1-(or 4)-(di-n-hexylaminomethyl)triazole, 1-(or 4)-(di-isooctylaminomethyl)triazole, 1-(or 4)-(di-(2-ethylhexyl)aminomethyl)triazole, 1-(or 4)-(di-n-decylaminomethyl)triazole, 1-(or 4)-(di-n-dodecylaminomethyl)triazole, 1-(or 4)-(di-n-octadecylaminomethyl)triazole, 1-(or 4)-(di-n-eicosylaminomethyl)triazole, 1-(or 4)-[di-(prop-2'-enyl) aminomethyl]triazole, 1-(or 4)-[di-(but-2'-enyl) aminomethyl]triazole, 1-(or 4)-[di-(eicos-2'-enyl) aminomethyl]triazole, 1-(or 4)-(di-cyclohexylaminomethyl) triazole, 1-(or 4)-(di-benzylaminomethyl)triazole, 1-(or 4)-(di-phenylaminomethyl)triazole, 1-(or 4)-(4'-morpholinomethyl)triazole, 1-(or 4)-(1'-pyrrolidinomethyl) triazole, 1-(or 4)-(1'-piperidinomethyl)triazole, 1-(or 4)-(1'-perhydroroazepinomethyl)triazole, 1-(or 4)-(2',2"-dihydroxyethyl)aminomethyl]triazole, 1-(or 4)-(dibutoxypropyl-aminomethyl) triazole, 1-(or 4)-(dibutylthiopropyl-aminomethyl)triazole, 1-(or 4)-(dibutylaminopropyl-aminomethyl)triazole, 1-(or -4)-(1-methanomine)-N,N-bis(2-ethylhexyl)-methyl benzotriazole, N,N-bis-(1- or 4-triazolylmethyl)laurylamine, N,N-bis-(1- or 4-triazolylmethyl)oleylamine, N,N-bis-(1- or 4-triazolylmethyl)ethanolamine and N,N,N',N'-tetra(1- or 4-triazolylmethyl)ethylene diamine.

Also, dihydrocarbyl dithiophosphate metal salts where the metal is aluminum, lead, tin, manganese, molybdenum, antimony, cobalt, nickel, zinc or copper, but most often zinc. Sulfur- and/or phosphorus- and/or halogen-containing compounds, such as sulfurized olefins and vegetable oils, tritolyl phosphate, tricresyl phosphate, chlorinated paraffins, alkyl and aryl di- and trisulfides, amine salts of mono- and dialkyl phosphates, amine salts of methylphosphonic acid, diethanolaminomethyltolyltriazole, di(2-ethylhexyl)-aminomethyltolyltriazole, derivatives of 2,5-dimercapto-1,3,4-thiadiazole, ethyl ((bisisopropyloxyphosphinothioyl)-thio) propionate, triphenyl thiophosphate (triphenyl phosphorothioate), tris(alkylphenyl)phosphorothioates and mixtures thereof (for example tris(isononylphenyl)phosphorothioate), diphenylmonononylphenyl phosphorothioate, isobutylphenyl diphenyl phosphorothioate, the dodecylamine salt of 3-hydroxy-1,3-thiaphosphetan 3-oxide, trithiophosphoric acid 5,5,5-tris(isooctyl 2-acetate), derivatives of 2-mercaptobenzothiazole, such as 1-(N,N-bis(2-ethylhexyl) aminomethyl)-2-mercapto-1H-1,3-benzothiazole or ethoxycarbonyl 5-octyldithiocarbamate.

The metal deactivating agents which can be used in the lubricating oil a composition of the present invention include benzotriazole and the 4-alkylbenzotriazoles such as 4-methylbenzotriazole and 4-ethylbenzotriazole; 5-alkylbenzotriazoles such as 5-methylbenzotriazole, 5-ethylbenzotriazole; 1-alkylbenzotriazoles such as 1-dioctylauainomethyl-2,3-benzotriazole; benzotriazole derivatives such as the 1-alkyltolutriazoles, for example, 1-dioctylaminomethyl-2,3-t-olutriazole; benzimidazole and benzimidazole derivatives such as 2-(alkyldithio)-benzimidazoles, for example, such as 2-(octyldithio)-benzimidazole, 2-(decyldithio)benzimidazole and 2-(dodecyldithio)-benzimidazole; 2-(alkyldithio)-toluimidazoles such as 2-(octyldithio)-toluimidazole, 2-(decyldithio)-toluimidazole and 2-(dodecyldithio)-toluimidazole; indazole and indazole derivatives of toluimidazoles such as 4-alkylindazole, 5-alkylindazole; benzothiazole, 2-mercaptobenzothiazole derivatives (manufactured by the Chiyoda Kagaku Co. under the trade designation "Thiolite B-3100") and 2-(alkyldithio)benzothiazoles such as 2-(hexyldithio)benzothiazole and 2-(octyldithio)benzothiazole; 2-(alkyl-dithio)toluthiazoles such as 2-(benzyldithio)toluthiazole and 2-(octyldithio)toluthiazole, 2-(N,N-dialkyldithiocarbamyl)benzothiazoles such as 2-(N,N-diethyldithiocarbamyl)benzothiazole, 2-(N,N-dibutyldithiocarbamyl)-benzotriazole and 2-N,N-dihexyldithiocarbamyl)benzotriazole; benzothiazole derivatives of 2-(N,N-dialkyldithiocarbamyl)toluthiazoles such as 2-(N,N-diethyldithiocarbamyl)toluthiazole, 2-(N,N-dibutyldithiocarbamyl)toluthiazole, 2-(N,N-dihexyl-dithiocarbamyl)-toluthiazole; 2-(alkyldithio)benzoxazoles such as 2-(octyldithio)benzoxazo-le, 2-(decyldithio)-benzoxazole and 2-(dodecyldithio)benzoxazole; benzoxazole derivatives of 2-(alkyldithio)toluoxazoles such as 2-(octyldithio)toluoxazole, 2-(decyldithio)toluoxazole, 2-(dodecyldithio)toluoxazole; 2,5-bis(alkyldithio)-1,3,4-thiadiazoles such as 2,5-bis(heptyldithio)-1,3,4-thiadiazole, 2,5-bis-(nonyldithio)-1,-3,4-thiadiazole, 2,5-bis(dodecyldithio)-1,3,4-thiadiazole and 2,5-bis-(octadecyldithio)-1,3,4-thiadiazole; 2,5-bis(N,N-dialkyl-dithiocarbamyl)-1,3,4-thiadiazoles such as 2,5-bis(N,N-diethyldithiocarbamyl)-1,3,-4-thiadiazole, 2,5-bis(N,N-dibutyldithiocarbamyl)-1,3,4-thiadiazole and 2,5-bis(N,N-dioctyldithiocarbamyl)1,3,4-thiadiazole; thiadiazole derivatives of 2-N,N-dialkyldithiocarbamyl-5-mercapto-1,3,4-thiadiazoles such as 2-N,N-dibutyldithiocarbamyl-5-mercapto-1,3,4-thiadiazole and 2-N,N-dioctyl-dithiocarbamyl-5-mercapto-1,3,4-thiadiazole, and triazole derivatives of 1-alkyl-2,4-triazoles such as 1-dioctylaminomethyl-2,4-triazole or concentrates and/or mixtures thereof.

Anti-wear agents/Extreme pressure agent/Friction Reducer: zinc alkyldithiophosphates, aryl phosphates and phosphites, sulfur-containing esters, phosphosulfur compounds, and metal or ash-free dithiocarbamates.

A phosphate ester or salt may be a monohydrocarbyl, dihydrocarbyl or a trihydrocarbyl phosphate, wherein each hydrocarbyl group is saturated. In one embodiment, each hydrocarbyl group independently contains from about 8 to about 30, or from about 12 up to about 28, or from about 14 up to about 24, or from about 14 up to about 18 carbons atoms. In one embodiment, the hydrocarbyl groups are alkyl groups.

Examples of hydrocarbyl groups include tridecyl, tetradecyl, pentadecyl, hexadecyl, heptadecyl, octadecyl groups and mixtures thereof.

A phosphate ester or salt is a phosphorus acid ester prepared by reacting one or more phosphorus acid or anhydride with a saturated alcohol. The phosphorus acid or anhydride is generally an inorganic phosphorus reagent, such as phosphorus pentoxide, phosphorus trioxide, phosphorus tetroxide, phosphorous acid, phosphoric acid, phosphorus halide, lower phosphorus esters, or a phosphorus sulfide, including phosphorus pentasulfide, and the like. Lower phosphorus acid esters generally contain from 1 to about 7 carbon atoms in each ester group. Alcohols used to prepare the phosphorus acid esters or salts. Examples of commercially available alcohols and alcohol mixtures include Alfol 1218 (a mixture of synthetic, primary, straight-chain alcohols containing 12 to 18 carbon atoms); Alfol 20+ alcohols (mixtures of C 18-C 28 primary alcohols having mostly C20 alcohols as determined by GLC (gas-liquid-chromatography)); and Alfol 22+ alcohols (C 18-C 28 primary alcohols containing primarily C 22 alcohols). Alfol alcohols are available from Continental Oil Company. Another example of a commercially available alcohol mixture is Adol 60 (about 75% by weight of a straight chain C 22 primary alcohol, about 15% of a C 20 primary alcohol and about 8% of C 18 and C 24 alcohols). The Adol alcohols are marketed by Ashland Chemical.

A variety of mixtures of monohydric fatty alcohols derived from naturally occurring triglycerides and ranging in chain length from C 8 to C 18 are available from Procter & Gamble Company. These mixtures contain various amounts of fatty alcohols containing 12, 14, 16, or 18 carbon atoms. For example, CO-1214 is a fatty alcohol mixture containing 0.5% of C 10 alcohol, 66.0% of C 12 alcohol, 26.0% of C 14 alcohol and 6.5% of C 16 alcohol.

Another group of commercially available mixtures include the "Neodol" products available from Shell Chemical Co. For example, Neodol 23 is a mixture of C 12 and C 13 alcohols; Neodol 25 is a mixture of C 12 to C 15 alcohols; and Neodol 45 is a mixture of C 14 to C 15 linear alcohols. The phosphate contains from about 14 to about 18 carbon atoms in each hydrocarbyl group. The hydrocarbyl groups of the phosphate are generally derived from a mixture of fatty alcohols having from about 14 up to about 18 carbon atoms. The hydrocarbyl phosphate may also be derived from a fatty vicinal diol. Fatty vicinal diols include those available from Ashland Oil under the general trade designation Adol 114 and Adol 158. The former is derived from a straight chain alpha olefin fraction of C 11-C 14, and the latter is derived from a C 15-C 18 fraction.

The phosphate salts may be prepared by reacting an acidic phosphate ester with an amine compound or a metallic base to form an amine or a metal salt. The amines may be monoamines or polyamines. Useful amines include those amines disclosed in U.S. Pat. No. 4,234,435.

The monoamines generally contain a hydrocarbyl group which contains from 1 to about 30 carbon atoms, or from 1 to about 12, or from 1 to about 6. Examples of primary monoamines useful in the present invention include methylamine, ethylamine, propylamine, butylamine, cyclopentylamine, cyclohexylamine, octylamine, dodecylamine, allylamine, cocoamine, stearylamine, and laurylamine. Examples of secondary monoamines include dimethylamine, diethylamine, dipropylamine, dibutylamine, dicyclopentylamine, dicyclohexylamine, methylbutylamine, ethylhexylamine, etc.

An amine is a fatty (C.sub.8-30) amine which includes n-octylamine, n-decylamine, n-dodecylamine, n-tetradecylamine, n-hexadecylamine, n-octadecylamine, oleyamine, etc. Also useful fatty amines include commercially available fatty amines such as "Armeen" amines (products available from Akzo Chemicals, Chicago, Ill.), such Armeen C, Armeen O, Armeen OL, Armeen T, Armeen HT, Armeen S and Armeen SD, wherein the letter designation relates to the fatty group, such as coco, oleyl, tallow, or stearyl groups.

Other useful amines include primary ether amines, such as those represented by the formula, R"(OR')×NH 2, wherein R' is a divalent alkylene group having about 2 to about 6 carbon atoms; x is a number from one to about 150, or from about one to about five, or one; and R" is a hydrocarbyl group of about 5 to about 150 carbon atoms. An example of an ether amine is available under the name SURFAM® amines produced and marketed by Mars Chemical Company, Atlanta, Ga. Preferred etheramines are exemplified by those identified as SURFAM P14B (decyloxypropylamine), SURFAM P16A (linear C 16), SURFAM P17B (tridecyloxypropylamine). The carbon chain lengths (i.e., C 14, etc.) of the SURFAMS described above and used hereinafter are approximate and include the oxygen ether linkage.

An amine is a tertiary-aliphatic primary amine. Generally, the aliphatic group, preferably an alkyl group, contains from about 4 to about 30, or from about 6 to about 24, or from about 8 to about 22 carbon atoms. Usually the tertiary alkyl primary amines are monoamines the alkyl group is a hydrocarbyl group containing from one to about 27 carbon atoms and R 6 is a hydrocarbyl group containing from 1 to about 12 carbon atoms. Such amines are illustrated by tert-butylamine, tert-hexylamine, 1-methyl-1-amino-cyclohexane, tert-octylamine, tert-decylamine, tert-dodecylamine, tert-tetradecylamine, tert-hexadecylamine, tert-octadecylamine, tert-tetracosanylamine, and tert-octacosanylamine. Mixtures of tertiary aliphatic amines may also be used in preparing the phosphate salt. Illustrative of amine mixtures of this type are "Primene 81R" which is a mixture of C 11-C 14 tertiary alkyl primary amines and "Primene JMT" which is a similar mixture of C 18-C 22 tertiary alkyl primary amines (both are available from Rohm and Haas Company). The tertiary aliphatic primary amines and methods for their preparation are known to those of ordinary skill in the art. The tertiary aliphatic primary amine useful for the purposes of this invention and methods for their preparation are described in U.S. Pat. An amine is a heterocyclic polyamine. The heterocyclic polyamines include aziridines, azetidines, azolidines, tetra- and dihydropyridines, pyrroles, indoles, piperidines, imidazoles, di- and tetra-hydroimidazoles, piperazines, isoindoles, purines, morpholines, thiomorpholines, N-aminoalkylmorpholines, N-aminoalkylthiomorpholines, N-aminoalkyl-piperazines, N,N'-diaminoalkylpiperazines, azepines, azocines, azonines, azecines and tetra-, di- and perhydro derivatives of each of the above and mixtures of two or more of these heterocyclic amines. Preferred heterocyclic amines are the saturated 5- and 6-membered heterocyclic amines containing only nitrogen, oxygen and/or sulfur in the hetero ring, especially the piperidines, piperazines, thiomorpholines, morpholines, pyrrolidines, and the like. Piperidine, aminoalkyl substituted piperidines, piperazine, aminoalkyl substituted piperazines, morpholine, aminoalkyl substituted morpholines, pyrrolidine, and aminoalkyl-substituted pyrrolidines, are especially preferred. Usually the aminoalkyl substituents are substituted on a nitrogen atom forming part of the hetero ring. Specific examples of such heterocyclic amines include N-aminopropylmorpholine, N-aminoethylpiperazine, and N,N'-diaminoethylpiperazine. Hydroxy heterocyclic polyamines are also useful. Examples include N-(2-hydroxyethyl)cyclohexylamine, 3-hydroxycyclopentylamine, parahydroxyaniline, N-hydroxyethylpiperazine, and the like.

The metal salts of the phosphorus acid esters are prepared by the reaction of a metal base with the acidic phosphorus ester. The metal base may be any metal compound capable of forming a metal salt. Examples of metal bases include metal oxides, hydroxides, carbonates, sulfates, borates, or the like. The metals of the metal base include Group IA, IIA, IB through VIIB, and VIII metals (CAS version of the Periodic Table of the Elements). These metals include the alkali metals, alkaline earth metals and transition metals. In one embodiment, the metal is a Group IIA metal, such as calcium or magnesium, Group IIB metal, such as zinc, or a Group VIIB metal, such as manganese. Preferably, the metal is magnesium, calcium, manganese or zinc. Examples of metal compounds which may be reacted with the phosphorus acid include zinc hydroxide, zinc oxide, copper hydroxide, copper oxide, etc.

Lubricating compositions also may include a fatty imidazoline or a reaction product of a fatty carboxylic acid and at least one polyamine. The fatty imidazoline has fatty substituents containing from 8 to about 30, or from about 12 to about 24 carbon atoms. The substituent may be saturated or unsaturated for example, heptadeceneyl derived olyel groups, preferably saturated. In one aspect, the fatty imidazoline may be prepared by reacting a fatty carboxylic acid with a polyalkylenepolyamine, such as those discussed above. The fatty carboxylic acids are generally mixtures of straight and branched chain fatty carboxylic acids containing about 8 to about 30 carbon atoms, or from about 12 to about 24, or from about 16 to about 18. Carboxylic acids include the polycarboxylic acids or carboxylic acids or anhydrides having from 2 to about 4 carbonyl groups, preferably 2. The polycarboxylic acids include succinic acids and anhydrides and Diels-Alder reaction products of unsaturated monocarboxylic acids with unsaturated carboxylic acids (such as acrylic, methacrylic, maleic, fumaric, crotonic and itaconic acids). Preferably, the fatty carboxylic acids are fatty monocarboxylic acids, having from about 8 to about 30, preferably about 12 to about 24 carbon atoms, such as octanoic, oleic, stearic, linoleic, dodecanoic, and tall oil acids, preferably stearic acid. The fatty carboxylic acid is reacted with at least one polyamine. The polyamines may be aliphatic, cycloaliphatic, heterocyclic or aromatic. Examples of the polyamines include alkylene polyamines and heterocyclic polyamines.

Hydroxyalkyl groups are to be understood as meaning, for example, monoethanolamine, diethanolamine or triethanolamine, and the term amine also includes diamine. The amine used for the neutralization depends on the phosphoric esters used. The EP additive according to the invention has the following advantages: It very high effectiveness when used in low concentrations and it is free of chlorine. For the neutralization of the phosphoric esters, the latter are taken and the corresponding amine slowly added with stirring. The resulting heat of neutralization is removed by cooling. The EP additive according to the invention can be incorporated into the respective base liquid with the aid of fatty substances (e.g. tall oil fatty acid, oleic acid, etc.) as solubilizers. The base liquids used are napthenic or paraffinic base oils, synthetic oils (e.g. polyglycols, mixed polyglycols), polyolefins, carboxylic esters, etc.

The composition comprises at least one phosphorus containing extreme pressure additive. Examples of such additives are amine phosphate extreme pressure additives such as that known under the trade name IRGALUBE 349 and/or triphenyl phosphorothionate extreme pressure/anti-wear additives such as that known under the trade name IRGALUBE TPPT. Such amine phosphates are suitably present in an amount of from 0.01 to 2%, preferably 0.2 to 0.6% by weight of the lubricant composition while such phosphorothionates are suitably present in an amount of from 0.01 to 3%, preferably 0.5 to 1.5% by weight of the lubricant composition. A mixture of an amine phosphate and phosphorothionate is employed.

At least one straight and/or branched chain saturated or unsaturated monocarboxylic acid which is optionally sulphurised in an amount which may be up to 35% by weight; and/or an ester of such an acid. At least one triazole or alkyl derivatives thereof, or short chain alkyl of up to 5 carbon atoms and is hydrogen, morphilino, alkyl, amido, amino, hydroxy or alkyl or aryl substituted derivatives thereof; or a triazole selected from 1,2,4 triazole, 1,2,3 triazole, 5-anilo-1,2,3,4-thiatriazole, 3-amino-1,2,4 triazole, 1-H-benzotriazole-1-yl-methylisocyanide, methylene-bis-benzotriazole and naphthotriazole; and The neutral organic phosphate which forms a component of the formulation may be present in an amount of 0.01 to 4%, preferably 1.5 to 2.5% by weight of the composition. The above amine phosphates and any of the aforementioned benzo- or tolyltriazoles can be mixed together to form a single component capable of delivering antiwear performance. The neutral organic phosphate is also a conventional ingredient of lubricating compositions and any such neutral organic phosphate falling within the formula as previously defined may be employed.

Phosphates for use in the present invention include phosphates, acid phosphates, phosphites and acid phosphites. The phosphates include triaryl phosphates, trialkyl phosphates, trialkylaryl phosphates, triarylalkyl phosphates and trialkenyl phosphates. As specific examples of these, referred to are triphenyl phosphate, tricresyl phosphate, benzyldiphenyl phosphate, ethyldiphenyl phosphate, tributyl phosphate, ethyldibutyl phosphate, cresyldiphenyl phosphate, dicresylphenyl phosphate, ethylphenyldiphenyl phosphate, diethylphenylphenyl phosphate, propylphenyldiphenyl phosphate, dipropylphenylphenyl phosphate, triethylphenyl phosphate, tripropylphenyl phosphate, butylphenyldiphenyl phosphate, dibutylphenylphenyl phosphate, tributylphenyl phosphate, trihexyl phosphate, tri(2-ethylhexyl)phosphate, tridecyl phosphate, trilauryl phosphate, trimyristyl phosphate, tripalmityl phosphate, tristearyl phosphate, and trioleyl phosphate. The acid phosphates include, for example, 2-ethylhexyl acid phosphate, ethyl acid phosphate, butyl acid phosphate, oleyl acid phosphate, tetracosyl acid phosphate, isodecyl acid phosphate, lauryl acid phosphate, tridecyl acid phosphate, stearyl acid phosphate, and isostearyl acid phosphate. The phosphites include, for example, triethyl phosphite, tributyl phosphite, triphenyl phosphite, tricresyl phosphite, tri(nonylphenyl)phosphite, tri(2-ethylhexyl) phosphite, tridecyl phosphite, trilauryl phosphite, triisooctyl phosphite, diphenylisodecyl phosphite, tristearyl phosphite, and trioleyl phosphite.

The acid phosphites include, for example, dibutyl hydrogenphosphite, dilauryl hydrogenphosphite, dioleyl hydrogenphosphite, distearyl hydrogenphosphite, and diphenyl hydrogenphosphite.

Amines that formamine salts with such phosphates include, for example, mono-substituted amines, di-substituted amines and tri-substituted amines. Examples of the mono-substituted amines include butylamine, pentylamine, hexylamine, cyclohexylamine, octylamine, laurylamine, stearylamine, oleylamine and benzylamine; and those of the di-substituted amines include dibutylamine, dipentylamine, dihexylamine, dicyclohexylamine, dioctylamine, dilaurylamine, distearylamine, dioleylamine, dibenzylamine, stearyl monoethanolamine, decyl monoethanolamine, hexyl monopropanolamine, benzyl monoethanolamine, phenyl monoethanolamine, and tolyl monopropanolamine. Examples of tri-substituted amines include tributylamine, tripentylamine, trihexylamine, tricyclohexylamine, trioctylamine, trilaurylamine, tristearylamine, trioleylamine, tribenzylamine, dioleyl monoethanolamine, dilauryl monopropanolamine, dioctyl monoethanolamine, dihexyl monopropanolamine, dibutyl monopropanolamine, oleyl diethanolamine, stearyl dipropanolamine, lauryl diethanolamine, octyl dipropanolamine, butyl diethanolamine, benzyl diethanolamine, phenyl diethanolamine, tolyl dipropanolamine, xylyl diethanolamine, triethanolamine, and tripropanolamine. Phosphates or their amine salts are added to the base oil in an amount of from 0.03 to 5% by weight, preferably from 0.1 to 4% by weight, relative to the total weight of the composition.

Carboxylic acids to be reacted with amines include, for example, aliphatic carboxylic acids, dicarboxylic acids (dibasic acids), and aromatic carboxylic acids. The aliphatic carboxylic acids have from 8 to 30 carbon atoms, and may be saturated or unsaturated, and linear or branched. Specific examples of the aliphatic carboxylic acids include pelargonic acid, lauric acid, tridecanoic acid, myristic acid, palmitic acid, stearic acid, isostearic acid, eicosanoic acid, behenic acid, triacontanoic acid, caproleic acid, undecylenic acid, oleic acid, linolenic acid, erucic acid, and linoleic acid. Specific examples of the dicarboxylic acids include octadecylsuccinic acid, octadecenylsuccinic acid, adipic acid, azelaic acid, and sebacic acid. One example of the aromatic carboxylic acids is salicylic acid. The amines to be reacted with carboxylic acids include, for example, polyalkylenepolyamines such as diethylenetriamine, triethylenetetramine, tetraethylenepentamine, pentaethylenehexamine, hexaethyleneheptamine, heptaethyleneoctamine, dipropylenetriamine, tetrapropylenepentamine, and hexabutyleneheptamine; and alkanolamines such as monoethanolamine and diethanolamine. Of these, preferred are a combination of isostearic acid and tetraethylenepentamine, and a combination of oleic acid and diethanolamine. The reaction products of carboxylic acids and amines are added to the base oil in an amount of from 0.01 to 5% by weight, preferably from 0.03 to 3% by weight, relative to the total weight of the composition.

Important components are phosphites, thiophosphites phosphates, and thiophosphates, including mixed materials having, for instance, one or two sulfur atoms, i.e., monothio- or dithio compounds. As used herein, the term "hydrocarbyl substituent" or "hydrocarbyl group" is used in its ordinary sense, which is well-known to those skilled in the art. Specifically, it refers to a group having a carbon atom directly attached to the remainder of the molecule and having predominantly hydrocarbon character. Examples of hydrocarbyl groups include:

Hydrocarbon substituents, that is, aliphatic (e.g., alkyl or alkenyl), alicyclic (e.g., cycloalkyl, cycloalkenyl) substituents, and aromatic-, aliphatic-, and alicyclic-substituted aromatic substituents, as well as cyclic substituents wherein the ring is completed through another portion of the molecule (e.g., two substituents together form an alicyclic radical); the substituted hydrocarbon substituents, that is, substituents containing non-hydrocarbon groups which, in the context of this invention, do not alter the predominantly hydrocarbon substituent (e.g., halo (especially chloro and fluoro), hydroxy, alkoxy, mercapto, alkylmercapto, nitro, nitroso, and sulfoxy); and hetero-atom containing substituents, that is, substituents which, while having a predominantly hydrocarbon character, in the context of this invention, contain other than carbon in a ring or chain otherwise composed of carbon atoms. Heteroatoms include sulfur, oxygen, nitrogen, and encompass substituents as pyridyl, furyl, thienyl and imidazolyl. In general, no more than two, preferably no more than one, non-hydrocarbon substituent will be present for every ten carbon atoms in the hydrocarbyl group; typically, there will be no non-hydrocarbon substituents in the hydrocarbyl group.

The term "hydrocarbyl group," in the context of the present invention, is also intended to encompass cyclic hydrocarbyl or hydrocarbylene groups, where two or more of the alkyl groups in the above structures together form a cyclic structure. The hydrocarbyl or hydrocarbylene groups of the present invention generally are alkyl or cycloalkyl groups which contain at least 3 carbon atoms. Preferably or optimally containing sulfur, nitrogen, or oxygen, they will contain 4 to 24, and alternatively 5 to 18 carbon atoms. In another embodiment they contain about 6, or exactly 6 carbon atoms. The hydrocarbyl groups can be tertiary or preferably primary or secondary groups; in one embodiment the component is a di(hydrocarbyl)hydrogen phosphite and each of the hydrocarbyl groups is a primary alkyl group; in another embodiment the component is a di(hydrocarbyl)hydrogen phosphite and each of the hydrocarbyl groups is a secondary alkyl group. In yet another embodiment the component is a hydrocarbylenehydrogen phosphite.

Examples of straight chain hydrocarbyl groups include methyl, ethyl, n-propyl, n-butyl, n-hexyl, n-octyl, n-decyl, n-dodecyl, n-tetradecyl, stearyl, n-hexadecyl, n-octadecyl, oleyl, and cetyl. Examples of branched-chain hydrocarbon groups include isopropyl, isobutyl, secondary butyl, tertiary butyl, neopentyl, 2-ethylhexyl, and 2,6-dimethylheptyl. Examples of cyclic groups include cyclobutyl, cyclopentyl, methylcyclopentyl, cyclohexyl, methylcyclohexyl, cycloheptyl, and cyclooctyl. A few examples of aromatic hydrocarbyl groups and mixed aromatic-aliphatic hydrocarbyl groups include phenyl, methylphenyl, tolyl, and naphthyl.

The R groups can also comprise a mixture of hydrocarbyl groups derived from commercial alcohols. Examples of some monohydric alcohols and alcohol mixtures include the commercially available "Alfol™" alcohols marketed by Continental Oil Corporation. Alfol™ 810, for instance, is a mixture containing alcohols consisting essentially of straight chain, primary alcohols having from 8 to 12 carbon atoms. Alfol™ 12 is a mixture of mostly C12 fatty alcohols; Alfol™ 22+ comprises C18-28 primary alcohols having mostly C 22 alcohols, and so on. Various mixtures of monohydric fatty alcohols derived from naturally occurring triglycerides and ranging in chain length from C 8 to C18 are available from Procter & Gamble Company. "Neodol™" alcohols are available from Shell Chemical Co., where, for instance, Neodol™ 25 is a mixture of C 12 to C 15 alcohols.

Specific examples of some of the phosphites and thiophosphites within the scope of the invention include phosphorous acid, mono-, di-, or tri-thiophosphorous acid, mono-, di-, or tri-propyl phosphite or mono-, di-, or tri-thiophosphite; mono-, di-, or tri-butyl phosphite or mono-, di-, or tri-thiophosphite; mono-, di-, or tri-amyl phosphite or mono-, di-, or tri-thiophosphite; mono-, di-, or tri-hexyl phosphite or mono-, di-, or tri-thiophosphite; mono-, di-, or tri-phenyl phosphite or mono-, di-, or tri-thiophosphite; mono-, di-, or tri-tolyl phosphite or mono-, di-, or tri-thiophosphite; mono-, di-, or tri-cresyl phosphite or mono-, di-, or tri-thiophosphite; dibutyl phenyl phosphite or mono-, di-, or tri-phosphite, amyl dicresyl phosphite or mono-, di-, or tri-thiophosphite, and any of the above with substituted groups, such as chlorophenyl or chlorobutyl.

Specific examples of the phosphates and thiophosphates within the scope of the invention include phosphoric acid, mono-, di-, or tri-thiophosphoric acid, mono-, di-, or tri-propyl phosphate or mono-, di-, or tri-thiophosphate; mono-, di-, or tri-butyl phosphate or mono-, di-, or tri-thiophosphate;

mono-, di-, or tri-amyl phosphate or mono-, di-, or tri-thiophosphate; mono-, di-, or tri-hexyl phosphate or mono-, di-, or tri-thiophosphate; mono-, di-, or tri-phenyl phosphate or mono-, di-, or tri-thiophosphate; mono-, di-, or tritolyl phosphate or mono-, di-, or trithiophosphate; mono-, di-, or tricresyl phosphate or mono-, di-, or tri-thiophosphate; dibutyl phenyl phosphate or mono-, di-, or tri-phosphate, amyl dicresyl phosphate or mono-, di-, or tri-thiophosphate, and any of the above with substituted groups, such as chlorophenyl or chlorobutyl.

The phosphorus compounds of the present invention are prepared by well known reactions. One route the reaction of an alcohol or a phenol with phosphorus trichloride or by a transesterification reaction. Alcohols and phenols can be reacted with phosphorus pentoxide to provide a mixture of an alkyl or aryl phosphoric acid and a dialkyl or diaryl phosphoric acid. Alkyl phosphates can also be prepared by the oxidation of the corresponding phosphites. Thiophosphates can be prepared by the reaction of phosphites with elemental sulfur. In any case, the reaction can be conducted with moderate heating. Moreover, various phosphorus esters can be prepared by reaction using other phosphorus esters as starting materials. Thus, medium chain (C9 to C22) phosphorus esters have been prepared by reaction of dimethylphosphite with a mixture of medium-chain alcohols by means of a thermal transesterification or an acid- or base-catalyzed transesterification; see for example U.S. Pat. No. 4,652,416. Most such materials are also commercially available; for instance, triphenyl phosphite is available from Albright and Wilson as Duraphos TPP™; di-n-butyl hydrogen phosphite from Albright and Wilson as Duraphos DBHP™; and triphenylthiophosphate from Ciba Specialty Chemicals as Irgalube TPPT™.

The other major component of the present composition is a hydrocarbon having ethylenic unsaturation. This would normally be described as an olefin or a diene, triene, polyene, and so on, depending on the number of ethylenic unsaturations present. Preferably the olefin is mono unsaturated, that is, containing only a single ethylenic double bond per molecule. The olefin can be a cyclic or a linear olefin. If a linear olefin, it can be an internal olefin or an alpha-olefin. The olefin can also contain aromatic unsaturation, i.e., one or more aromatic rings, provided that it also contains ethylenic (non-aromatic) unsaturation.

The olefin normally will contain 6 to 30 carbon atoms. Olefins having significantly fewer than 6 carbon atoms tend to be volatile liquids or gases which are not normally suitable for formulation into a composition suitable as an antiwear lubricant. Preferably the olefin will contain 6 to 18 or 6 to 12 carbon atoms, and alternatively 6 or 8 carbon atoms.

Among suitable olefins are alkyl-substituted cyclopentenes, hexenes, cyclohexene, alkyl-substituted cyclohexenes, heptenes, cycloheptenes, alkyl-substituted cycloheptenes, octenes including diisobutylene, cyclooctenes, alkyl-substituted cyclooctenes, nonenes, decenes, undecenes, dodecenes including propylene tetramer, tridecenes, tetradecenes, pentadecenes, hexadecenes, heptadecenes, octadecenes, cyclooctadiene, norbornene, dicyclopentadiene, squalene, diphenylacetylene, and styrene. Highly preferred olefins are cyclohexene and 1-octene.

Examples of esters of the dialkylphosphorodithioic acids include esters obtained by reaction of the dialkyl phosphorodithioic acid with an alpha, beta-unsaturated carboxylic acid (e.g., methyl acrylate) and, optionally an alkylene oxide such as propylene oxide.

Generally, the compositions of the present invention will contain varying amounts of one or more of the above-identified metal dithiophosphates such as from about 0.01 to about 2% by weight, and more generally from about 0.01 to about 1% by weight, based on the weight of the total composition.

The hydrocarbyl in the dithiophosphate may be alkyl, cycloalkyl, aralkyl or alkaryl groups, or a substantially hydrocarbon group of similar structure. Illustrative alkyl groups include isopropyl, isobutyl, n-butyl, sec-butyl, the various amyl groups, n-hexyl, methylisobutyl, heptyl, 2-ethylhexyl, diisobutyl, isooctyl, nonyl, behenyl, decyl, dodecyl, tridecyl, etc. Illustrative lower alkylphenyl groups include butylphenyl, amylphenyl, heptylphenyl, etc. Cycloalkyl groups likewise are useful and these include chiefly cyclohexyl and the lower alkyl-cyclohexyl radicals. Many substituted hydrocarbon groups may also be used, e.g., chloropentyl, dichlorophenyl, and dichlorodecyl.

The phosphorodithioic acids from which the metal salts useful in this invention are prepared are well known. Examples of dihydrocarbylphosphorodithioic acids and metal salts, and processes for preparing such acids and salts are found in, for example U.S. Pat. Nos. 4,263,150; 4,289,635; 4,308,154; and 4,417,990. These patents are hereby incorporated by reference.

The phosphorodithioic acids are prepared by the reaction of a phosphorus sulfide with an alcohol or phenol or mixtures of alcohols. A typical reaction involves four moles of the alcohol or phenol and one mole of phosphorus pentasulfide, and may be carried out within the temperature range from about 50 C. to about 200 C. Thus, the preparation of O,O-di-n-hexyl phosphorodithioic acid involves the reaction of a mole of phosphorus pentasulfide with four moles of n-hexyl alcohol at about 100 C for about two hours. Hydrogen sulfide is liberated and the residue is the desired acid. The preparation of the metal salts of these acids may be effected by reaction with metal compounds as well known in the art.

The metal salts of dihydrocarbyldithiophosphates which are useful in this invention include those salts containing Group I metals, Group II metals, aluminum, lead, tin, molybdenum, manganese, cobalt, and nickel. The Group II metals, aluminum, tin, iron, cobalt, lead, molybdenum, manganese, nickel and copper are among the preferred metals. Zinc and copper are especially useful metals. Examples of metal compounds which may be reacted with the acid include lithium oxide, lithium hydroxide, sodium hydroxide, sodium carbonate, potassium hydroxide, potassium carbonate, silver oxide, magnesium oxide, magnesium hydroxide, calcium oxide, zinc hydroxide, strontium hydroxide, cadmium oxide, cadmium hydroxide, barium oxide, aluminum oxide, iron carbonate, copper hydroxide, lead hydroxide, tin butylate, cobalt hydroxide, nickel hydroxide, nickel carbonate, and the like.

In some instances, the incorporation of certain ingredients such as small amounts of the metal acetate or acetic acid in conjunction with the metal reactant will facilitate the reaction and result in an improved product. For example, the use of up to about 5% of zinc acetate in combination with the required amount of zinc oxide facilitates the formation of a zinc phosphorodithioate with potentially improved performance properties.

Especially useful metal phosphorodithloates can be prepared from phosphorodithloic acids which in turn are prepared by the reaction of phosphorus pentasulfide with mixtures of alcohols. In addition, the use of such mixtures enables the utilization of less expensive alcohols which individually may not yield oil-soluble phosphorodithioic acids. Thus a mixture of isopropyl and hexylalcohols can be used to produce a very effective, oil-soluble metal phosphorodithioate. For the same reason mixtures of phosphorodithioic acids can be reacted with the metal compounds to form less expensive, oil-soluble salts.

The mixtures of alcohols may be mixtures of different primary alcohols, mixtures of different secondary alcohols or mixtures of primary and secondary alcohols. Examples of useful mixtures include: n-butanol and n-octanol; n-pentanol and 2-ethyl-1-hexanol; isobutanol and n-hexanol; isobutanol and isoamyl alcohol; isopropanol and 2-methyl-4-pentanol; isopropanol and sec-butyl alcohol; isopropanol and isooctyl alcohol; and the like.

Organic triesters of phosphorus acids are also employed in lubricants. Typical esters include triarylphosphates, trialkyl phosphates, neutral alkylaryl phosphates, alkoxyalkyl phosphates, triaryl phosphite, trialkylphosphite, neutral alkyl aryl phosphites, neutral phosphonate esters and neutral phosphine oxide esters. In one embodiment, the long chain dialkyl phosphonate esters are used. More preferentially, the dimethyl-, diethyl-, and dipropyl-oleyl phosphonates can be used. Neutral acids of phosphorus acids are the triesters rather than an acid (HO—P) or a salt of an acid.

Any C4 to C8 alkyl or higher phosphate ester may be employed in the invention. For example, tributyl phosphate (TBP) and tri isooctal phosphate (TOF) can be used. The specific triphosphate ester or combination of esters can easily be selected by one skilled in the art to adjust the density, viscosity etc. of the formulated fluid. Mixed esters, such as dibutyl octyl phosphate or the like may be employed rather than a mixture of two or more trialkyl phosphates.

A trialkyl phosphate is often useful to adjust the specific gravity of the formulation, but it is desirable that the specific trialkyl phosphate be a liquid at low temperatures. Consequently, a mixed ester containing at least one partially alkylated with a C3 to C4 alkyl group is very desirable, for example, 4-isopropylphenyl diphenyl phosphate or 3-butylphenyl diphenyl phosphate. Even more desirable is a triaryl phosphate produced by partially alkylating phenol with butylene or propylene to form a mixed phenol which is then reacted with phosphorus oxychloride as taught in U.S. Pat. No. 3,576,923.

Any mixed triaryl phosphate (TAP) esters may be used as cresyl diphenyl phosphate, tricresyl phosphate, mixed xylyl cresyl phosphates, lower alkylphenyl/phenyl phosphates, such as mixed isopropylphenyl/phenyl phosphates, t-butylphenyl phenyl phosphates. These esters are used extensively as plasticizers, functional fluids, gasoline additives, flame-retardant additives and the like.

An Extreme pressure agent, sulfur-based extreme pressure agents, such as sulfides, sulfoxides, sulfones, thiophosphinates, thiocarbonates, sulfurized fats and oils, sulfurized olefins and the like; phosphorus-based extreme pressure agents, such as phosphoric acid esters (e.g., tricresyl phosphate (TCP) and the like), phosphorous acid esters, phosphoric acid ester amine salts, phosphorous acid ester amine salts, and the like; halogen-based extreme pressure agents, such as chlorinated hydrocarbons and the like; organometallic extreme pressure agents, such as thiophosphoric acid salts (e.g., zinc dithiophosphate (ZnDTP) and the like) and thiocarbamic acid salts; and the like can be used. As the anti-wear agent, organomolybdenum compounds such as molybdenum dithiophosphate (MoDTP), molybdenum dithiocarbamate (MoDTC) and the like; organoboric compounds such as alkylmercaptyl borate and the like; solid lubricant anti-wear agents such as graphite, molybdenum disulfide, antimony sulfide, boron compounds, polytetrafluoroethylene and the like; and the like can be used.

The phosphoric acid ester, thiophosphoric acid ester, and amine salt thereof functions to enhance the lubricating performances, and can be selected from known compounds conventionally employed as extreme pressure agents. Generally employed are phosphoric acid esters, a thiophosphoric acid ester, or an amine salt thereof which has an alkyl group, an alkenyl group, an alkylaryl group, or an aralkyl group, any of which contains approximately 3 to 30 carbon atoms.

Examples of the phosphoric acid esters include aliphatic phosphoric acid esters such as triisopropyl phosphate, tributyl phosphate, ethyl dibutyl phosphate, trihexyl phosphate, tri-2-ethylhexyl phosphate, trilauryl phosphate, tristearyl phosphate, and trioleyl phosphate; and aromatic phosphoric acid esters such as benzyl phenyl phosphate, allyl diphenyl phosphate, triphenyl phosphate, tricresyl phosphate, ethyl diphenyl phosphate, cresyl diphenyl phosphate, dicresyl phenyl phosphate, ethylphenyl diphenyl phosphate, diethylphenyl phenyl phosphate, propylphenyl diphenyl phosphate, dipropylphenyl phenyl phosphate, triethylphenyl phosphate, tripropylphenyl phosphate, butylphenyl diphenyl phosphate, dibutylphenyl phenyl phosphate, and tributylphenyl phosphate. Preferably, the phosphoric acid ester is a trialkylphenyl phosphate.

Examples of the thiophosphoric acid esters include aliphatic thiophosphoric acid esters such as triisopropyl thiophosphate, tributyl thiophosphate, ethyl dibutyl thiophosphate, trihexyl thiophosphate, tri-2-ethylhexyl thiophosphate, trilauryl thiophosphate, tristearyl thiophosphate, and trioleyl thiophosphate; and aromatic thiophosphoric acid esters such as benzyl phenyl thiophosphate, allyl diphenyl thiophosphate, triphenyl thiophosphate, tricresyl thiophosphate, ethyl diphenyl thiophosphate, cresyl diphenyl thiophosphate, dicresyl phenyl thiophosphate, ethylphenyl diphenyl thiophosphate, diethylphenyl phenyl thiophosphate, propylphenyl diphenyl thiophosphate, dipropylphenyl phenyl thiophosphate, triethylphenyl thiophosphate, tripropylphenyl thiophosphate, butylphenyl diphenyl thiophosphate, dibutylphenyl phenyl thiophosphate, and tributylphenyl thiophosphate. Preferably, the thiophosphoric acid ester is a trialkylphenyl thiophosphate.

Also employable are amine salts of the above-mentioned phosphates and thiophosphates. Amine salts of acidic alkyl or aryl esters of the phosphoric acid and thiophosphoric acid are also employable. Preferably, the amine salt is an amine salt of trialkylphenyl phosphate or an amine salt of alkyl phosphate.

One or any combination of the compounds selected from the group consisting of a phosphoric acid ester, a thiophosphoric acid ester, and an amine salt thereof may be used.

The phosphorus acid ester and/or its amine salt function to enhance the lubricating performances, and can be selected from known compounds conventionally employed as extreme pressure agents. Generally employed are a phosphorus acid ester or an amine salt thereof which has an alkyl group, an alkenyl group, an alkylaryl group, or an aralkyl group, any of which contains approximately 3 to 30 carbon atoms.

Examples of the phosphorus acid esters include aliphatic phosphorus acid esters such as triisopropyl phosphite, tributyl phosphite, ethyl dibutyl phosphite, trihexyl phosphite, tri-2-ethylhexylphosphite, trilauryl phosphite, tristearyl phosphite, and trioleyl phosphite; and aromatic phosphorus acid esters such as benzyl phenyl phosphite, allyl diphenylphosphite, triphenyl phosphite, tricresyl phosphite, ethyl diphenyl phosphite, tributyl phosphite, ethyl dibutyl phosphite, cresyl diphenyl phosphite, dicresyl phenyl phosphite, ethylphenyl diphenyl phosphite, diethylphenyl phenyl phosphite, propylphenyl diphenyl phosphite, dipropylphenyl phenyl phosphite, triethylphenyl phosphite, tripropylphenyl phosphite, butylphenyl diphenyl phosphite, dibutylphenyl phenyl phosphite, and tributylphenyl phosphite. Also favorably employed are dilauryl phosphite, dioleyl phosphite, dialkyl phosphites, and diphenyl phosphite. Preferably, the phosphorus acid ester is a dialkyl phosphite or a trialkyl phosphite.

The phosphate salt may be derived from a polyamine. The polyamines include alkoxylated diamines, fatty polyamine diamines, alkylenepolyamines, hydroxy containing polyamines, condensed polyamines arylpolyamines, and heterocyclic polyamines. Commercially available examples of alkoxylated diamines include those amine where y in the above formula is one. Examples of these amines include Ethoduomeen T/13 and T/20 which are ethylene oxide condensation products of N-tallowtrimethylenediamine containing 3 and 10 moles of ethylene oxide per mole of diamine, respectively.

In another embodiment, the polyamine is a fatty diamine. The fatty diamines include mono- or dialkyl, symmetrical or asymmetrical ethylene diamines, propane diamines (1,2, or 1,3), and polyamine analogs of the above. Suitable commercial fatty polyamines are Duomeen C. (N-coco-1,3-diaminopropane), Duomeen S(N-soya-1,3-diaminopropane), Duomeen T (N-tallow-1,3-diaminopropane), and Duomeen O (N-oleyl-1,3-diaminopropane). "Duomeens" are commercially available from Armak Chemical Co., Chicago, Ill.

Such alkylenepolyamines include methylenepolyamines, ethylenepolyamines, butylenepolyamines, propylenepolyamines, pentylenepolyamines, etc. The higher homologs and related heterocyclic amines such as piperazines and N-amino alkyl-substituted piperazines are also included. Specific examples of such polyamines are ethylenediamine, triethylenetetramine, tris-(2-aminoethyl)amine, propylenediamine, trimethylenediamine, tripropylenetetramine, tetraethylenepentamine, hexaethyleneheptamine, pentaethylenehexamine, etc. Higher homologs obtained by condensing two or more of the above-noted alkyleneamines are similarly useful as are mixtures of two or more of the aforedescribed polyamines.

In one embodiment the polyamine is an ethylenepolyamine. Such polyamines are described in detail under the heading Ethylene Amines in Kirk Othmer's "Encyclopedia of Chemical Technology", 2d Edition, Vol. 7, pages 22-37, Interscience Publishers, New York (1965). Ethylenepolyamines are often a complex mixture of polyalkylenepolyamines including cyclic condensation products.

Other useful types of polyamine mixtures are those resulting from stripping of the above-described polyamine mixtures to leave, as residue, what is often termed "polyamine bottoms". In general, alkylenepolyamine bottoms can be characterized as having less than 2%, usually less than 1% (by weight) material boiling below about 200 C. A typical sample of such ethylene polyamine bottoms obtained from the Dow Chemical Company of Freeport, Tex. designated "E-100". These alkylenepolyamine bottoms include cyclic condensation products such as piperazine and higher analogs of diethylenetriamine, triethylenetetramine and the like. These alkylenepolyamine bottoms can be reacted solely with the acylating agent or they can be used with other amines, polyamines, or mixtures thereof. Another useful polyamine is a condensation reaction between at least one hydroxy compound with at least one polyamine reactant containing at least one primary or secondary amino group. The hydroxy compounds are preferably polyhydric alcohols and amines. The polyhydric alcohols are described below. (See carboxylic ester dispersants.) In one embodiment, the hydroxy compounds are polyhydric amines. Polyhydric amines include any of the above-described monoamines reacted with an alkylene oxide (e.g., ethylene oxide, propylene oxide, butylene oxide, etc.) having from two to about 20 carbon atoms, or from two to about four. Examples of polyhydric amines include tri-(hydroxypropyl)amine, tris-(hydroxymethyl) amino methane, 2-amino-2-methyl-1,3-propanediol, N,N,N',N'-tetrakis(2-hydroxypropyl)ethylenediamine, and N,N,N',N'-tetrakis(2-hydroxyethyl)ethylenediamine, preferably tris (hydroxymethyl)aminomethane (THAM).

Polyamines which react with the polyhydric alcohol or amine to form the condensation products or condensed amines, are described above. Preferred polyamines include triethylenetetramine (TETA), tetraethylenepentamine (TEPA), pentaethylenehexamine (PEHA), and mixtures of polyamines such as the above-described "amine bottoms".

Examples of extreme pressure additives include sulphur-based extreme pressure additives such as dialkyl sulphides, dibenzyl sulphide, dialkyl polysulphides, dibenzyl disulphide, alkyl mercaptans, dibenzothiophene and 2,2'-dithiobis (benzothiazole); phosphorus-based extreme pressure additives such as trialkyl phosphates, triaryl phosphates, trialkyl phosphonates, trialkyl phosphites, triaryl phosphites and dialkylhydrozine phosphites, and phosphorus- and sulphur-based extreme pressure additives such as zinc dialkyldithiophosphates, dialkylthiophosphoric acid, trialkyl thiophosphate esters, acidic thiophosphate esters and trialkyl trithiophosphates. These extreme pressure additives can be used individually or in the form of mixtures, conveniently in an amount within the range from 0.1 to 2 parts by weight, per 100 parts by weight of the base oil.

All the above can be performance enhanced using a variety of cobase stocks, AN, AB, ADPO, ADPS, ADPM, and/or a variety of mono-basic, di-basic, and tribasic esters in conjunction with low sulfur, low aromatic, low iodine number, low bromine number, high analine point, isoparafin.

EXAMPLES

We have discovered several novel formulations that provide enhanced air release properties. These formulations are shown below in Table 3 as Examples 1 through 6. A commercially available gear oil package is shown for reference as example 7. All lubricant formulations in Table 1 are blended to International Standard Organization ("ISO") viscosity grade 320. Viscosity grade 320 is the predominant recommendation from most Wind turbine builders.

TABLE 3

| | Example: | | | | | | |
|---|---|---|---|---|---|---|---|
| Component | 1 | 2 | 3 | 4 | 5 | 6 | 7 |
| Adipate Ester | 10.00 | 10.00 | 10.00 | 10.00 | 10.00 | 10.00 | 10.00 |
| PAO 2 cSt | 14.00 | 14.00 | — | — | — | — | — |
| PAO 4 cSt | — | — | 18.00 | 18.00 | 31.00 | 40.00 | — |
| PAO 6 cSt | — | — | — | — | — | — | 22.00 |
| PAO 100 cSt | — | — | — | — | — | — | 64.60 |
| Hi VI PAO 150 cSt | 73.10 | 73.15 | 69.10 | 69.15 | — | — | — |
| Hi VI PAO 300 cSt | — | — | — | — | 56.10 | — | — |
| Hi VI PAO 620 cSt | — | — | — | — | — | 47.10 | — |
| Oil Additive Package 1 | 2.90 | — | 2.90 | — | 2.90 | 2.90 | — |
| Oil Additive Package 2 | — | 2.85 | — | 2.85 | — | — | — |
| Oil Additive Package 3 | — | — | — | — | — | — | 3.40 |

Table 3 shows the different possibilities of the examples of the current invention, Example 1-6, with typical synthetic gear oil (example 7). In the preferred embodiment, the use of "Extreme-Modal" viscosities of the base stocks is employed in blending the finished lubricant. That is, the choice of the base stock viscosities of the blend components is intentionally selected to be as far apart as possible. Of note is the availability of shear stable synthetic base stocks of 150 cSt (KV100) or higher, up to 900 cSt (kv100) was not possible until very recently due to the innovative use of Mettallocene base catalysis for the synthesis of these materials.

Examples 1 & 2 use the 150 cSt base stock blended against the 2 cSt base stock to obtain an ISO 320 oil. As shown in Table 3, Examples 1 and 2 include the respective assemblage of additives from gear oil package 1 in Example 1 or gear oil package 2 in Example 2. Both Example 1 and 2 have adipate ester dissolved in a wide "bi-modal" hydrocarbon blend of high viscosity index PAO 150 cSt and PAO 2. Table 2 demonstrates these "bi-modal" blends and additives result in improved Scanning Brookfield Viscosities and pour points.

Examples 3 & 4 use the 150 cSt base stock blended against the 4 cSt base stock to obtain an ISO 320 oil. Examples 3 and 4 demonstrate that the assemblage of additives from gear oil package 1 in Example 3 or gear oil package 3 in Example 4. Both examples have adipate ester dissolved in a wide "bi-modal" hydrocarbon blend of high viscosity index PAO 150 cSt and PAO 4.

Example 5 uses the 300 cSt base stock blended against the 4 cSt base stock to obtain an ISO 320 oil. Example 6 uses the 620 cSt base stock blended against the 4 cSt base stock to obtain an ISO 320 oil. A typical ISO 320 lubricant (Example 7) is normally blended with the PAO 100 and PAO 6. The enhanced Air release properties and the improvement of the low temperature capabilities are due to the use of the aforementioned novel selection of base stock viscosities.

In one embodiment, no VI improvers are needed due to the high inherent VI of the base stocks. This benefit permits the ability to avoid VI improvers that may adversely affect shear stability. In this embodiment, the shear stability of the lubricant should be less than 15 percent and even more preferably less than 10 percent and in the most preferred embodiment, there will be essentially no VI improvers.

In a preferred embodiment, no transition or alkali metals are used in the finished formulation. This finished formulation would provide enhanced hydrolytic stability.

In another embodiment, another benefit of the improved base stocks properties is the ability to use less additives. In a preferred embodiment, the base stock combination provides the ability to use treat rates less than 10 percent and less than 5 percent.

While the examples have been to gear oils, these examples are not intended to be limiting. The novel formulations provides improved properties of all lubricating uses including but not limited to industrial, engine and hydraulic oils.

What is claimed is:

1. A lubricating oil formulation prepared from a blend of components comprised of:

at least 47.10 wt % metallocene catalyzed PAO having a viscosity of greater than or equal to 150 cSt, Kv 100° C., based on total weight of the blend components of the formulation;

not greater than 40.00 wt % PAO having viscosity of less than 10 cSt, Kv 100° C., based on total weight of the blend components of the formulation; and at least one cohase stock selected from the group consisting of alkylated naphthalene, alkylated benzene, alkylated diphenyloxide, alkylated diphenylsulfide, alkylated diphenylmethane, mono-basic esters, di-basic esters, and tri-basic esters, wherein the lubricating oil formulation has a viscosity greater than 3.5 cSt, Kv 100° C., and a viscosity index greater than 120, and wherein the lubricating oil formulation exhibits an air release time to 0.2% air of 17 minutes or less, according to ASTM D3427.

2. The lubricating oil formulation of claim 1, wherein the lubricating oil formulation blend components are blended to International Standard Organization viscosity grade 320.

3. The lubricating oil formulation of claim 1, wherein the metallocene catalyzed PAO having a viscosity of greater than or equal to 150 cSt, Kv 100° C., comprises at least 56.10 wt % of the total weight of the blend components of the formulation.

4. The lubricating oil formulation of claim 1, wherein the formulation is prepared from a blend comprised of not greater than 40.00 wt % PAO having a viscosity of not greater than 4 cSt, KV 100° C., based on total weight of the blend components of the formulation.

5. The lubricating oil formulation of claim 1, wherein the at least one cobase stock includes adipate ester.

6. A lubricating oil formulation prepared from a blend of components comprised of:

at least 47.10 wt % metallocene catalyzed PAO having a viscosity of greater than or equal to 150 cSt, Kv 100° C., based on total weight of the blend components of the formulation;

at least 5 percent and not more than 30 percent PAO having a viscosity of less than 6 cSt, KV 100° C., based on total weight of the blend components of the formulation; and at least one cobase stock selected from the group consisting of alkylated naphthalene, alkylated benzene, alkylated diphenyloxide, alkylated diphenylsulfide, alkylated diphenylmethane, mono-basic esters, di-basic esters, and tri-basic esters, wherein the lubricating oil formulation has a viscosity greater than 3.5 cSt, Kv 100° C., and a viscosity index greater than 120.

7. The lubricating oil formulation of claim 6, wherein the lubricating oil formulation blend components are blended to International Standard Organization viscosity grade 320.

8. The lubricating oil formulation of claim 6, wherein the at east one cobase stock includes adipate ester.

9. A method of preparing a lubricating oil composition having reduced air entrainment, comprising blending together at least the following components:

at least 47.10 svt % metallocene catalyzed PAO having a viscosity of greater than or equal to 150 cSt, Kv 100° C., based on total weight of the blend components of the formulation;

not greater than 40.00 wt % PAO having a viscosity of less than 10 cSt, Kv 100° C., based on total weight of the blend components of the formulation; and at least one cobase stock selected from the group consisting of alkylated naphthalene, alkylated benzene, alkylated diphenyloxide, alkylated diphenyisulfide, alkylated diphenylmethane, mono-basic esters, di-basic esters, and tri-basic esters, wherein the lubrication oil composition exhibits an air release time to 0.2% air of 17 minutes or less, according to ASTM D3427.

10. The method of claim 9, wherein the lubricating oil formulation blend components are blended to International Standard Organization viscosity grade 320.

11. The method of claim 9, wherein the metallocene catalyzed PAO having a viscosity of greater than or equal to 150 cSt, Kv 100° C., comprises at least 56.10 wt % of the total weight of the blend components of the formulation.

12. The method of claim 9, wherein the formulation is prepared from a blend comprised of not greater than 40.00 wt % PAO having a viscosity of not greater than 4 cSt, Kv 100° C., based on total weight of the blend components of the formulation.

13. The method of claim 9, wherein the at least one cobase stock includes adipate ester,

14. A method of preparing a lubricating oil composition having reduced air entrainment, comprising blending together at least the following components:

at least 47.10 wt % metallocene catalyzed PAO haying a viscosity of greater than or equal to 150 cSt, Kv 100° C., based on total weight of the blend components of the formulation;

at least 5 percent and not more than 30 percent PAO having viscosity of less than 6 cSt, Kv 100° C., based on total weight of the blend components of the formulation; and at least one cobase stock selected from the group consisting of alkylated naphthalene. alkylated benzene, alkylated diphenyloxide, alkylated diphenylsulfide, alkylated diphenylmethane, mono-basic esters, di-basic esters, and tri-basic esters, wherein the lubrication oil composition exhibits an air release time to 0.2% air of 17 minutes or less, according to ASTM D3427.

15. The method of claim 14, wherein the lubricating oil formulation blend components are blended to International Standard Organization viscosity grade 320.

16. The method of claim 14, wherein the at least one cobase stock includes adipate, ester.

* * * * *